US006024304A

United States Patent [19]

Sawada

[11] Patent Number: 6,024,304

[45] Date of Patent: Feb. 15, 2000

[54] PARTICLE FEEDER

[75] Inventor: Noboru Sawada, Hoya, Japan

[73] Assignee: Cold Jet, Inc., Loveland, Ohio

[21] Appl. No.: 08/328,330

[22] Filed: Oct. 24, 1994

[51] Int. Cl.[7] ..... A01C 3/06

[52] U.S. Cl. ..... 239/654; 239/143; 406/113

[58] Field of Search ..... 239/654, 143, 239/144, 341, 346, 366, 369, 318, 407; 222/464.7, 202, 388; 406/113–116

[56] References Cited

U.S. PATENT DOCUMENTS

| | | | |
|---|---|---|---|
| 1,364,532 | 1/1921 | Porat | 406/116 |
| 2,187,376 | 1/1940 | Guibert | 239/654 |
| 2,327,895 | 8/1943 | Holden | 239/654 |
| 3,018,135 | 1/1962 | Reib | 406/116 |
| 3,437,272 | 4/1969 | Abplanalp | 239/318 |
| 3,876,260 | 4/1975 | Moss et al. | 406/115 |
| 3,884,528 | 5/1975 | Shaddock | 406/115 |
| 3,987,937 | 10/1976 | Coucher | 406/115 |
| 4,389,820 | 6/1983 | Fong et al. | 51/410 |
| 4,505,623 | 3/1985 | Mulder | 406/114 |
| 4,511,284 | 4/1985 | Sterner | 239/654 |
| 4,630,929 | 12/1986 | Medlin | 239/654 |
| 4,659,262 | 4/1987 | Van Aalst | 406/115 |
| 4,744,181 | 5/1988 | Moore et al. | 51/436 |
| 4,843,770 | 7/1989 | Crane et al. | 51/439 |
| 4,896,833 | 1/1990 | Brody | 239/654 |
| 4,947,592 | 8/1990 | Lloyd et al. | 51/436 |
| 5,018,667 | 5/1991 | Lloyd | 239/132.5 |
| 5,050,805 | 9/1991 | Lloyd et al. | 239/424 |
| 5,063,015 | 11/1991 | Lloyd et al. | 264/161 |
| 5,071,289 | 12/1991 | Spivak | 406/11 |
| 5,074,342 | 12/1991 | Kraehn | 406/115 |
| 5,109,636 | 5/1992 | Lloyd et al. | 51/320 |
| 5,178,333 | 1/1993 | Barber et al. | 239/654 |
| 5,186,388 | 2/1993 | Chapman et al. | 239/143 |
| 5,188,151 | 2/1993 | Young et al. | 137/874 |
| 5,203,794 | 4/1993 | Stratford et al. | 51/410 |
| 5,301,509 | 4/1994 | Lloyd et al. | 62/35 |
| 5,328,517 | 7/1994 | Cates et al. | 134/7 |
| 5,351,890 | 10/1994 | Clements | 239/143 |
| 5,473,903 | 12/1995 | Lloyd et al. | 62/35 |
| 5,571,335 | 11/1996 | Lloyd | 134/1 |

FOREIGN PATENT DOCUMENTS

| | | | |
|---|---|---|---|
| 4218331 | 12/1993 | Germany | 406/115 |
| 288525 | 11/1989 | Japan | 406/114 |
| 112146 | 5/1995 | Japan . | |
| 148747 | 6/1995 | Japan . | |
| 1470633 | 4/1989 | U.S.S.R. | 406/115 |
| 1664661 | 7/1991 | U.S.S.R. | 406/116 |

*Primary Examiner*—Andres Kashnikow
*Assistant Examiner*—Lisa Ann Douglas
*Attorney, Agent, or Firm*—Frost & Jacobs LLP

[57] ABSTRACT

A feeder for transporting particles, such as carbon dioxide pellets, includes a container for receiving particles and a suction nozzle having an inlet end disposed adjacent a discharge area of the container. The nozzle is configured generally as a pipe having a circular cross-sectional area. The nozzle is reciprocally carried by the feeder so that the inlet end may be moved into and away from the particles to prevent the particles from clogging. The container bottom is generally shaped as a chute to direct/move the particles toward the discharge area. A vibrator may be used to assist in the movement of the particles. The nozzle may be reciprocated manually or automatically. Alternatively, the nozzle may be stationary and a mechanical assist included to move the particles toward the discharge area.

19 Claims, 28 Drawing Sheets

PARTICLE FEEDER

TECHNICAL FIELD

The present invention relates generally to feeders for feeding particulate material for transportation by a transport gas, such material including carbon dioxide pellets or particles, powder, grain or other granular type material. The invention will be specifically disclosed in connection with a feeder for use with particle blast systems, and more specifically, systems utilizing carbon dioxide pellets as the blast media.

BACKGROUND OF THE INVENTION

Feeders for feeding particulate material, such as powder, granular material, carbon dioxide into a flow of transport gas are well known in the art. Such prior art units include a container for holding the particles to be fed, a suction nozzle mounted on the container with an open inlet disposed near the bottom of the container. The suction nozzle is connected to a flow of gas so as to create suction at the nozzle inlet. The container is configured so as to direct the particles toward and into the inlet end of the suction nozzle.

With such conventional feeders, which are constructed in a way only to utilize the suction force present at the inlet end of the nozzle to draw in adjacent particles, the suction nozzle can become clogged by the particles, thereby reducing the efficiency of the feeder. In some instances, the particles become unable to flow into the inlet of the suction nozzle, instead collecting in the vicinity thereof.

SUMMARY OF THE INVENTION

It is object of this invention to obviate the above-described problems and shortcoming of the prior art heretofore available.

It is another object of the present invention to provide a feeder for feeding particles into a flow wherein the flow of particles is substantially uniform, while preventing the suction nozzle of the feeder from clogging up with the particles.

It is yet another object of the present invention to provide a feeder for transporting particles in which the particles do not collect around the opening of the nozzle of the feeder thereby interfering with the uniform flow of the particles into the nozzle.

It is another object of the present invention to provide a feeder which is simple, can be manufactured at lower cost, and in addition, can be easily moved to any given place for use.

It is still further object of the present invention to provide a particular blast cleaning system which utilizes the improved feeder described herein.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, there is provided a feeder for transporting particles, which includes a container for receiving particles, a nozzle having an inlet end disposed adjacent a discharge area of the container, and means for creating relative motion between said inlet end and said discharge area. The nozzle is configured generally as a pipe having a circular cross-sectional area. The nozzle is reciprocally carried by the feeder so that the inlet end may be moved into and away from the particles. The container bottom is generally shaped as a chute to direct/move the particles toward the discharge area. A vibrator may be used to assist in the movement of the particles.

In various other aspects of the invention, the means for moving the nozzle may be manually or automatically operated.

In yet another aspect of the invention, the nozzle may be maintained stationary, with a mechanically assisting device, such as a screw, conveyer belt or rotary valve, advancing the particles into the discharge area.

Still other objects of the present invention will become apparent to those skilled in this art from the following description wherein there is shown and described a preferred embodiment of this invention, simply by way of illustration, of one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
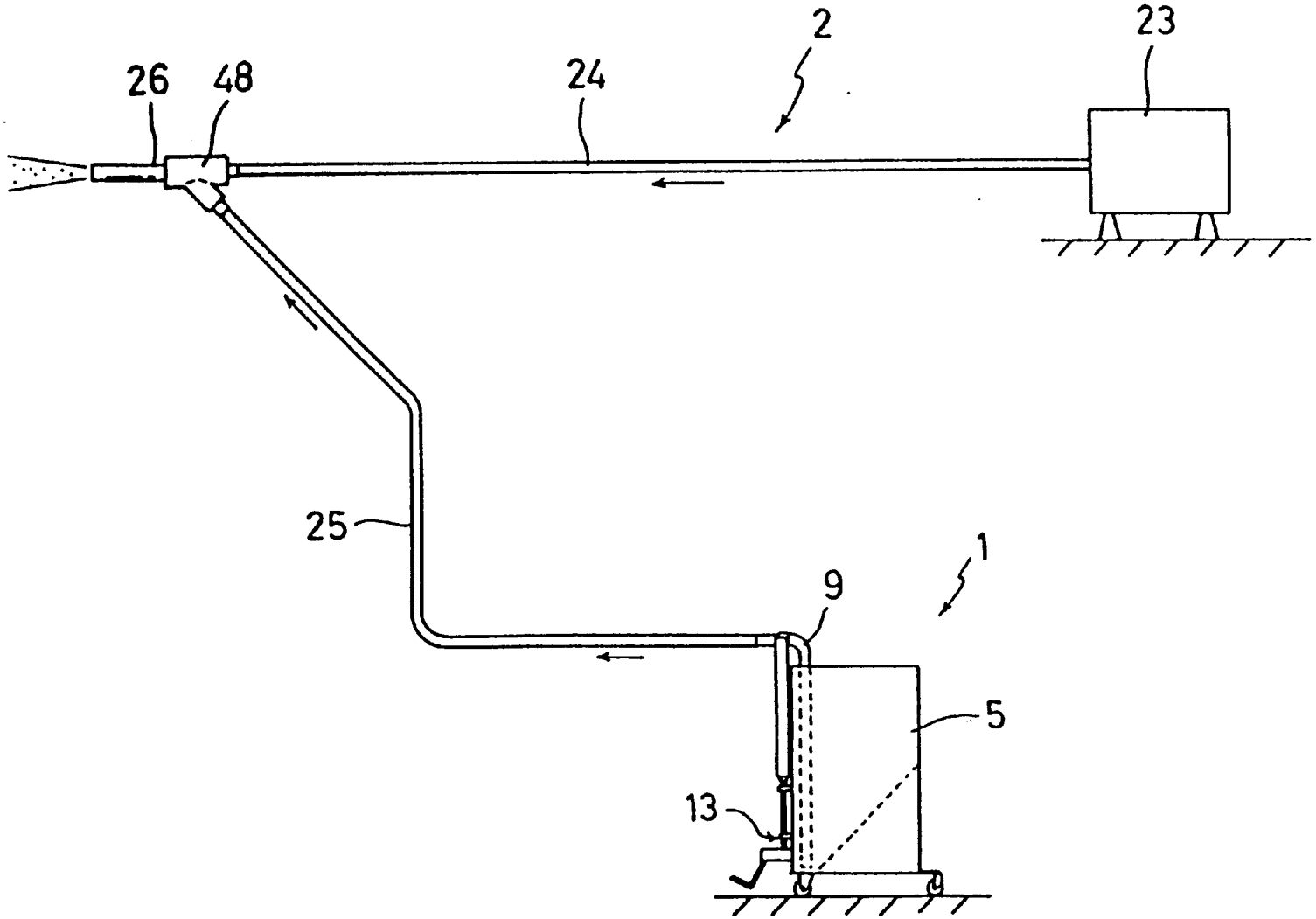
FIG. 1 is a diagrammatic view generally showing a partial blast feeding apparatus according to a first embodiment of the present invention.

Referring now to the drawings in detail, wherein like numerals indicate like elements throughout the views, FIGS. 1–6 illustrate a first preferred embodiment. FIG. 1 illustrates a particle blast cleaning apparatus utilizing feeder 1 which is constructed according to the first preferred embodiment of the present invention. The particle blast cleaning apparatus also includes a "suction unit" generally indicated at 2 which is comprised of compressor 23 which is connected to ejector 48 by air-supply hose 24. Suction unit 2 is referred to as the suction unit because it induces a vacuum in particle supply line 25 and, concomitantly, suction nozzle 9 of feeder 1 by virtue of its connection to particle supply line 25 through ejector 48. As shown in FIG. 1, the particle blast cleaning apparatus includes nozzle 26 located downstream of ejector 48. In operation, air compressor 23 provides a source of air flow through air supply line 24, thereby inducing a vacuum in particle supply line 25 and drawing particles from feeder 1 through suction nozzle 9, into and through particle supply line 25 to ejector 48 and out nozzle 26.

Figure 2:
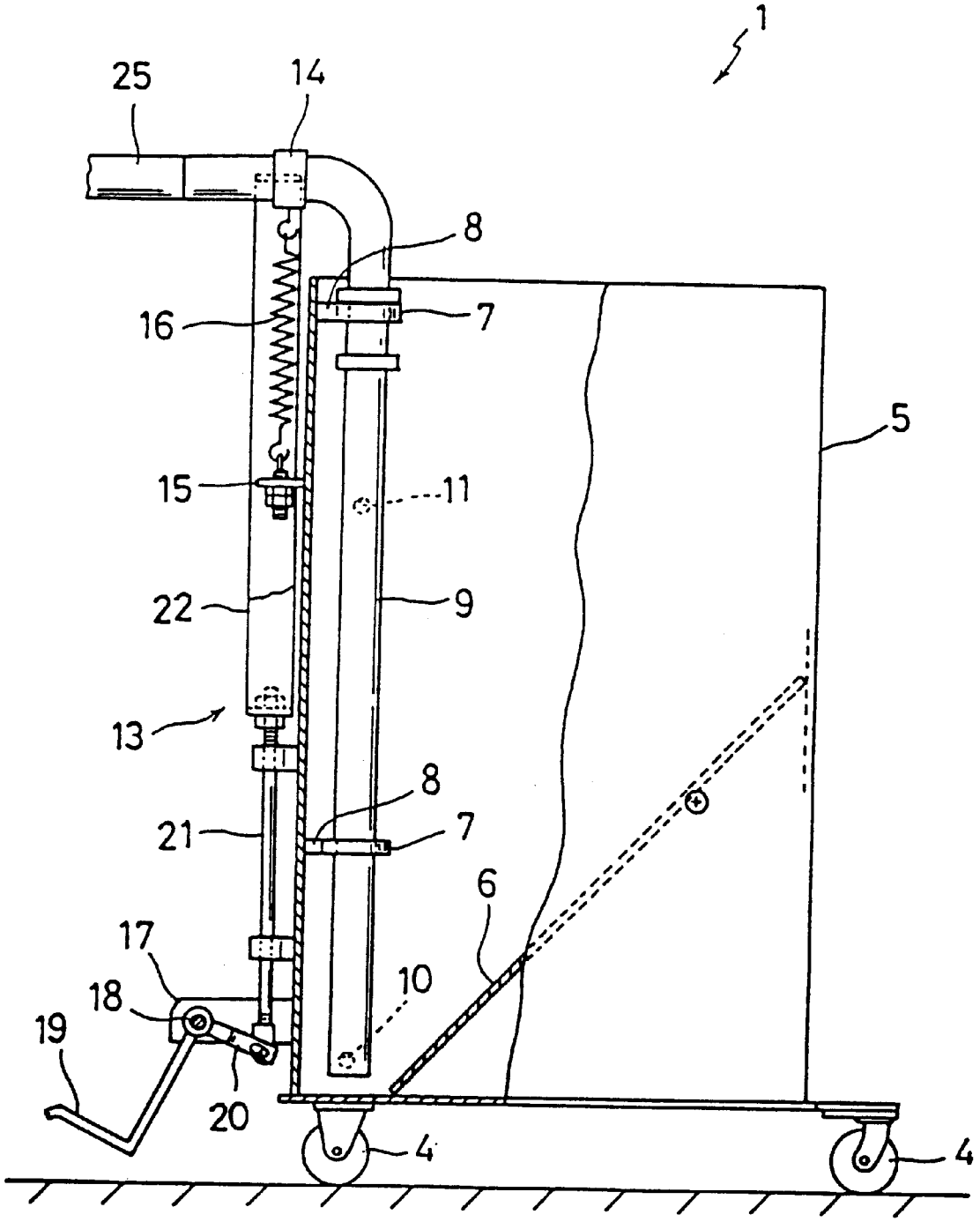
FIG. 2 is a side view in partial cross-section of a feeder according to a first embodiment of the present invention.

As shown in more detail in FIG. 2, feeder 1 includes container vessel 5, also referred to as a container or hopper, having an opening at the upper part thereof for receiving particles, and having at least three or more casters 4 at its lower end to allow feeder 1 to be moved across the floor. Container 5 includes means for directing/moving particles disposed therein towards a discharge area adjacent the lower end of suction nozzle 9, i.e., the suction nozzle inlet. As shown in FIG. 2, this means includes the configuration of chute 6 or a bottom which is inclined toward the discharge area so as to direct particles 3 (see FIG. 6) to one side of the lower part of container 5 toward a discharge area. Suction nozzle 9 is "pipe shaped", having a generally circular cross-section with the upper end thereof being bent at almost ninety degrees. Suction nozzle 9 is slidably carried by a plurality of sleeves 7 which are secured by brackets 8 to feeder 1. This construction allows suction nozzle 9 to freely reciprocate relative to the discharge area. Nozzle 9 can reciprocate generally vertically in the embodiment shown in FIG. 2.

Figure 5:
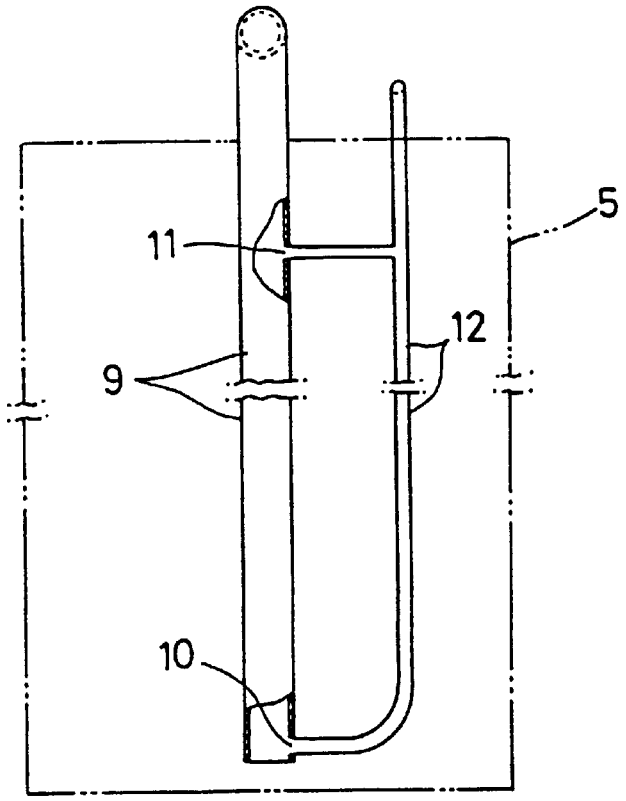
FIG. 5 is a fragmentary side view, partially cut away, illustrating the suction nozzle of the feeder according to a first preferred embodiment of the present invention.

As shown in more detail in FIG. 5, air-supply line 12, which has an inside diameter less than that of suction nozzle 9 (i.e. has a smaller cross-sectional area), is connected to the interior of suction nozzle 9 through lower and upper air-supply holes 10 and 11, respectively. Air supply hole 11 is positioned higher than the upper end portion of container 5.

Figure 3:
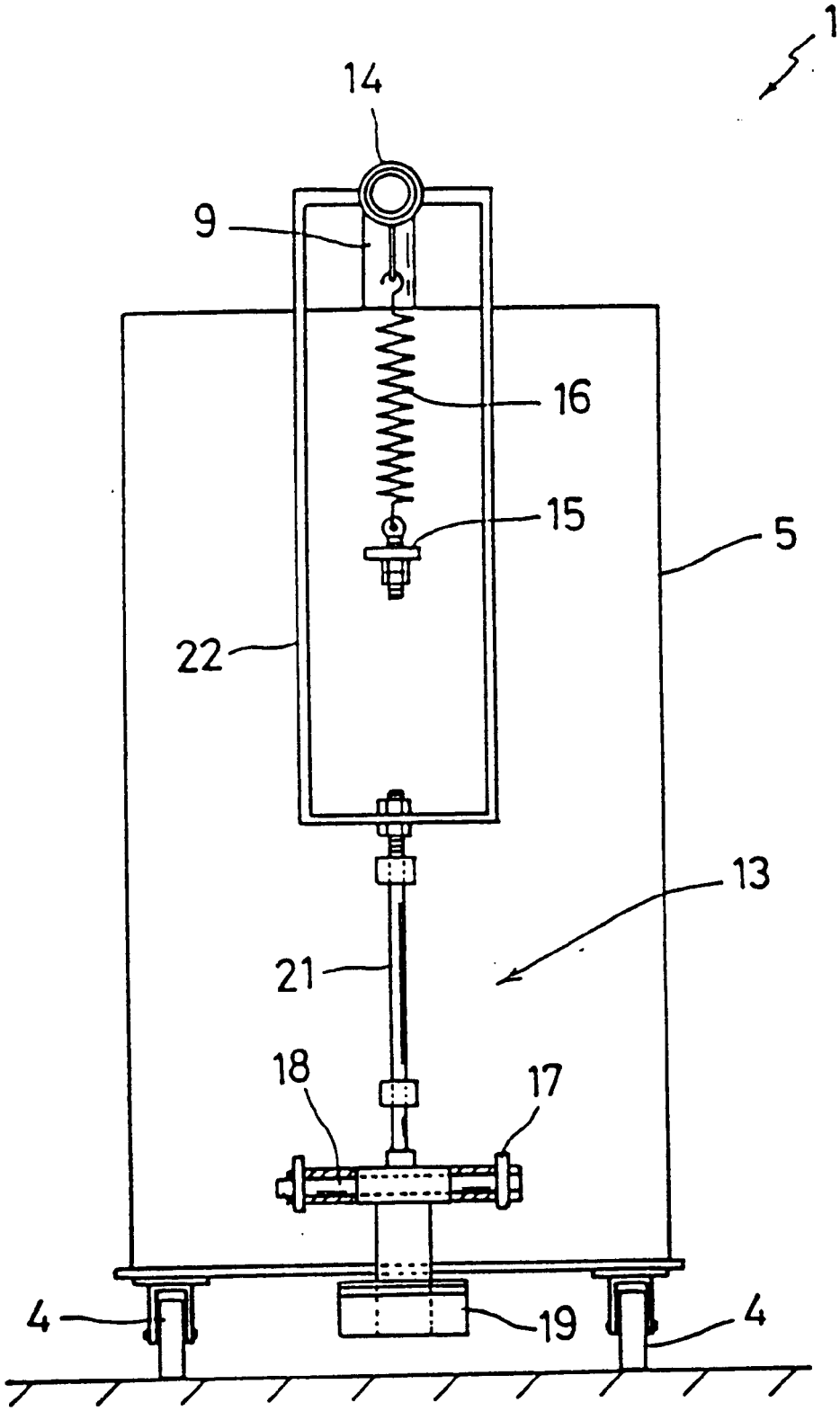
FIG. 3 is a side view of the feeder shown in FIG. 2.
Figure 4:
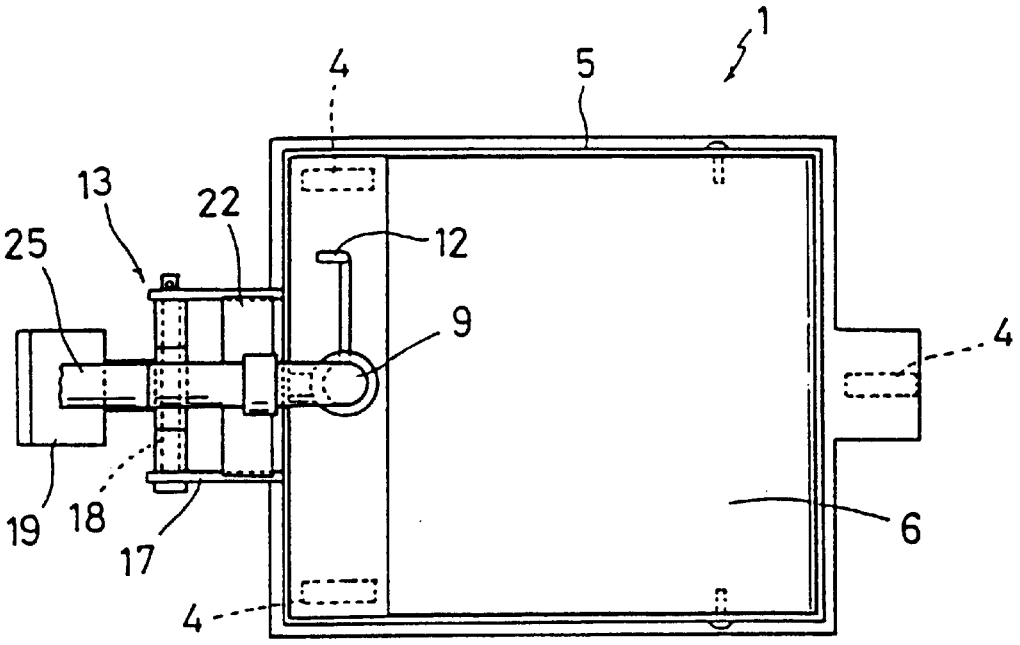
FIG. 4 is a plan view of the feeder shown in FIG. 3.

Turning to FIGS. 2, 3 and 4 there is illustrated means 13 for moving suction nozzle 9 relative to the discharge area. Means 13 includes metal frame 22 which is secured to the upper end of suction nozzle 9 adjacent the approximate ninety degree bend therein by clamp 14. Spring 16 is secured at its lower end to an outside wall of feeder 1 by bracket 15, and is secured at its upper end to suction nozzle 9 at clamp 14. Foot pedal 19 is rotatably carried by shaft 18 which is secured to feeder 1 through support bracket 17. Lever 20 is rigidly connected to and rotates with foot pedal 19. The distal end of lever 20 is connected to the lower end of actuating rod 21. The upper end of actuating rod 21 is secured to the lower end of frame 22.

Figure 6:
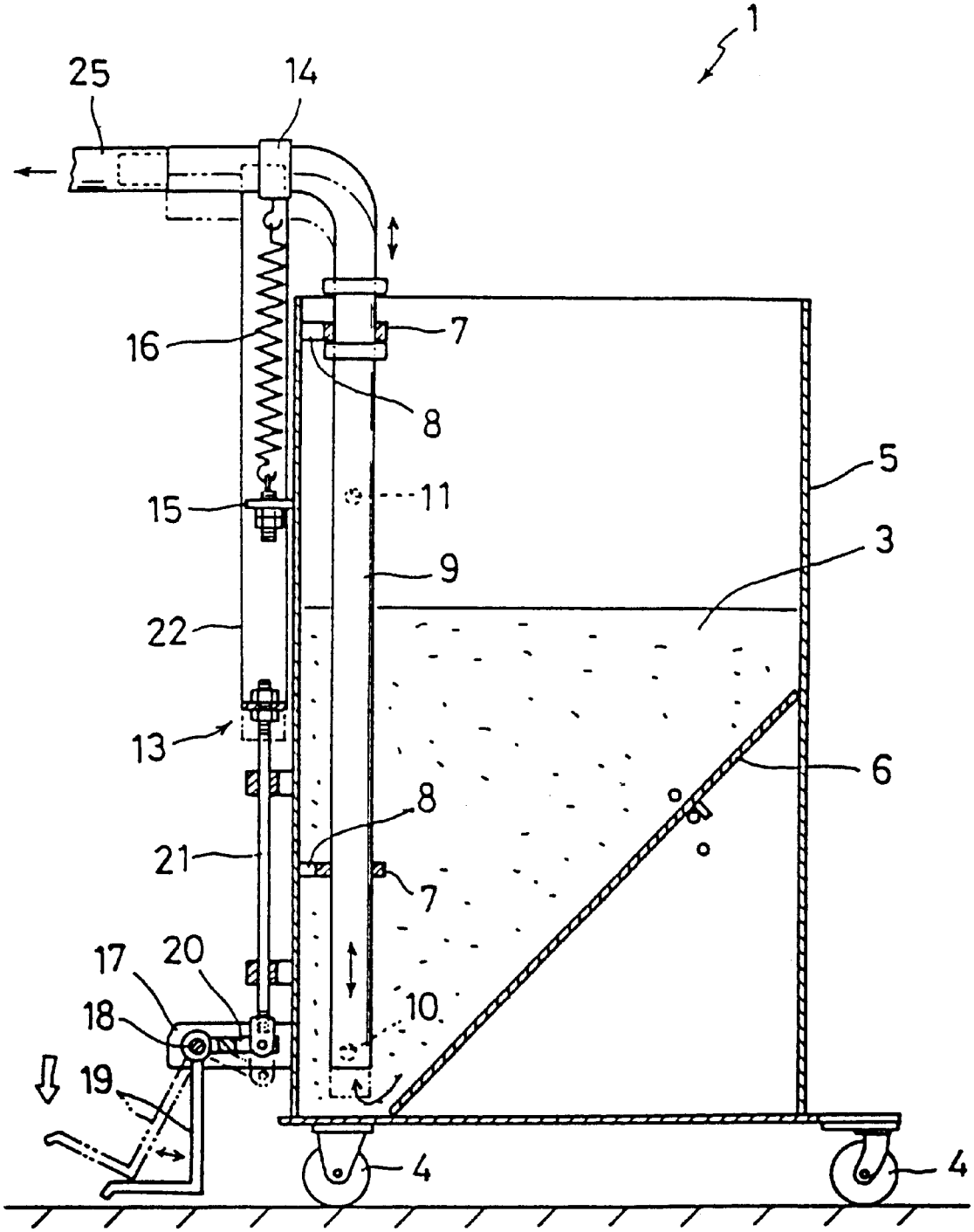
FIG. 6 is a cross-sectional side view of the feeder shown in FIG. 3, illustrating the operation of the feeder.

As can be seen in FIG. 6, by depressing foot pedal 19, suction nozzle 9 moves upwardly, with a concomitant upward movement of the inlet of suction nozzle 9 relative to the discharge area. By releasing foot pedal 19, spring 16 urges suction nozzle 9 and its inlet end and downwardly toward the discharge area. Thus, when the particle blast cleaning apparatus is in operation, with nozzle 26 open and air from compressor 23 flowing therethrough, particles located in container 5, such as dry ice particles or pellets are sucked from the discharge area into suction nozzle 9 and through connecting pipe and out nozzle 26. During this operation, suction nozzle 9 is reciprocated with respect to the discharge area by at least several millimeters by means 13. By this movement of suction nozzle 9, particles such as dry ice, are aspirated into suction nozzle 9 smoothly and uniformly, while preventing the clogging up of the suction nozzle due to the particles flowing therein. Additionally, the mass of particles, such as dry ice, can be prevented from collecting near the inlet of suction nozzle 9 which potentially could block particles from flowing therein. Additionally, air is supplied to suction nozzle 9 through lower air supply hose 10 such that particles can be sucked in smoothly and uniformly even if suction nozzle 9 should become clogged due to the particles. For example, in the event of clogging of the inlet of suction nozzle 9, the air flow through supply holes 10 and 11 create a stronger suction force at the clogged area, with such increase suction force being capable of unclogging the inlet of suction nozzle 9.

Referring now to FIGS. 7–41, additional preferred embodiments of the present invention are described, without any limitations as to their importance or use as part of the present invention.

Figure 7:
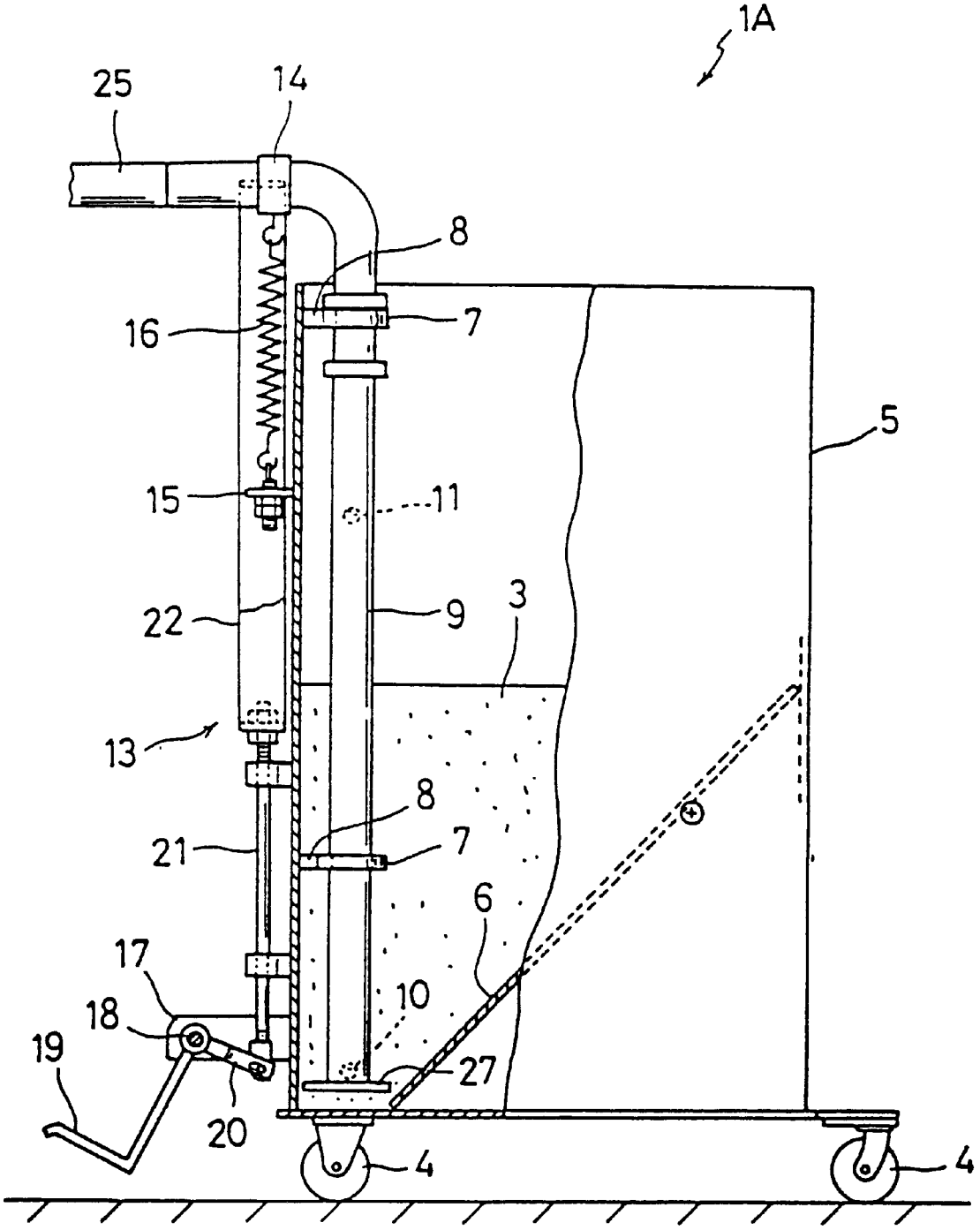
FIG. 7 is a side view, in partial cross-section, of a feeder according to a second preferred embodiment of the present invention.
Figure 8:
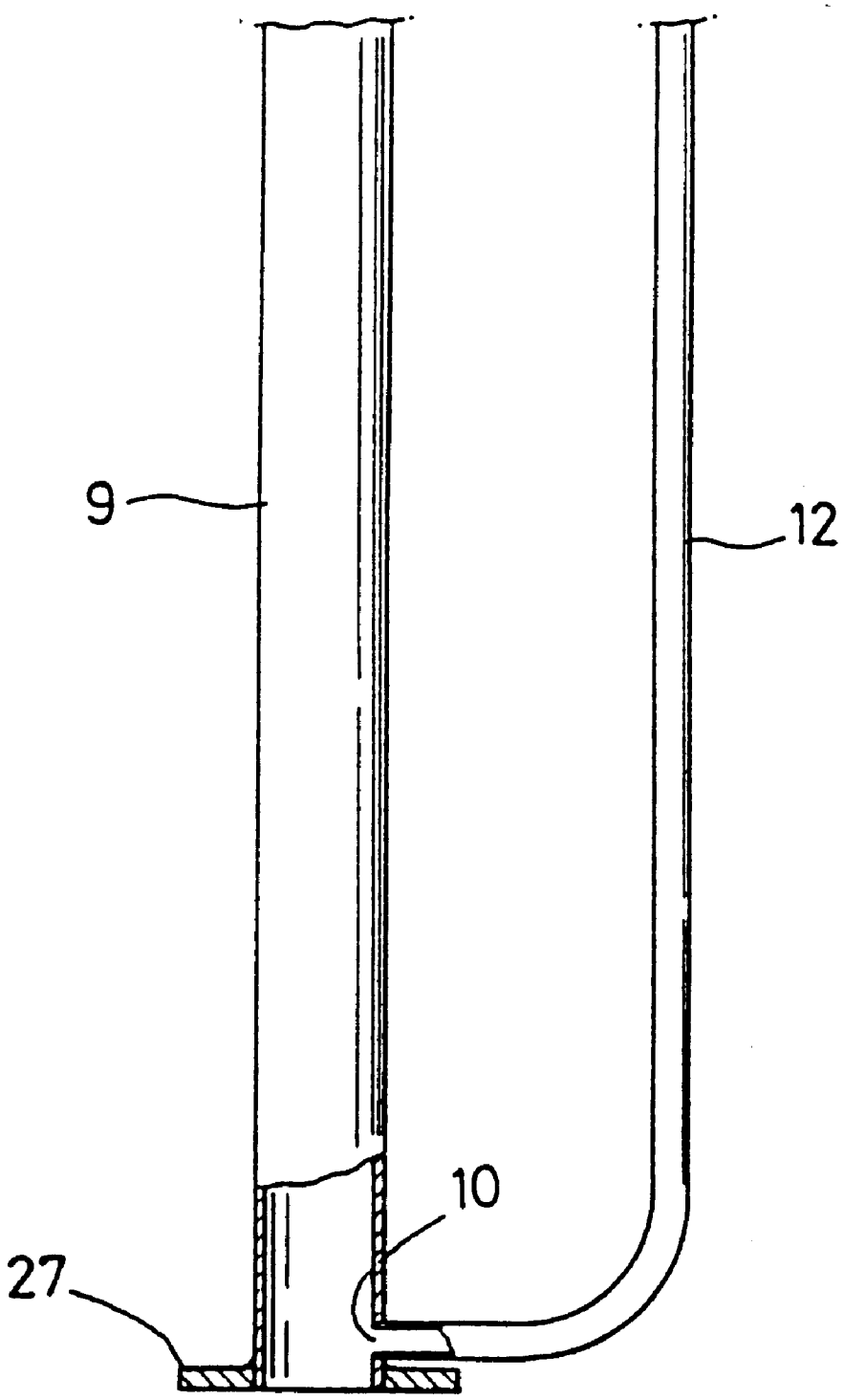
FIG. 8 is an enlarged, fragmentary side veiw of the suction nozzle shown in FIG. 7, in partial cross-section.

FIGS. 7 and 8 illustrate a second preferred embodiment of the present invention. Feeder 1A is generally constructed in accordance with the previous description of feeder 1 with suction nozzle 9 including inlet regulating plate 27, a generally planar plate extending radially outward from the inlet of suction nozzle 9. Plate 27 helps to prevent the coagulation of the mass of particles near the inlet of suction nozzle 9.

Figure 9:
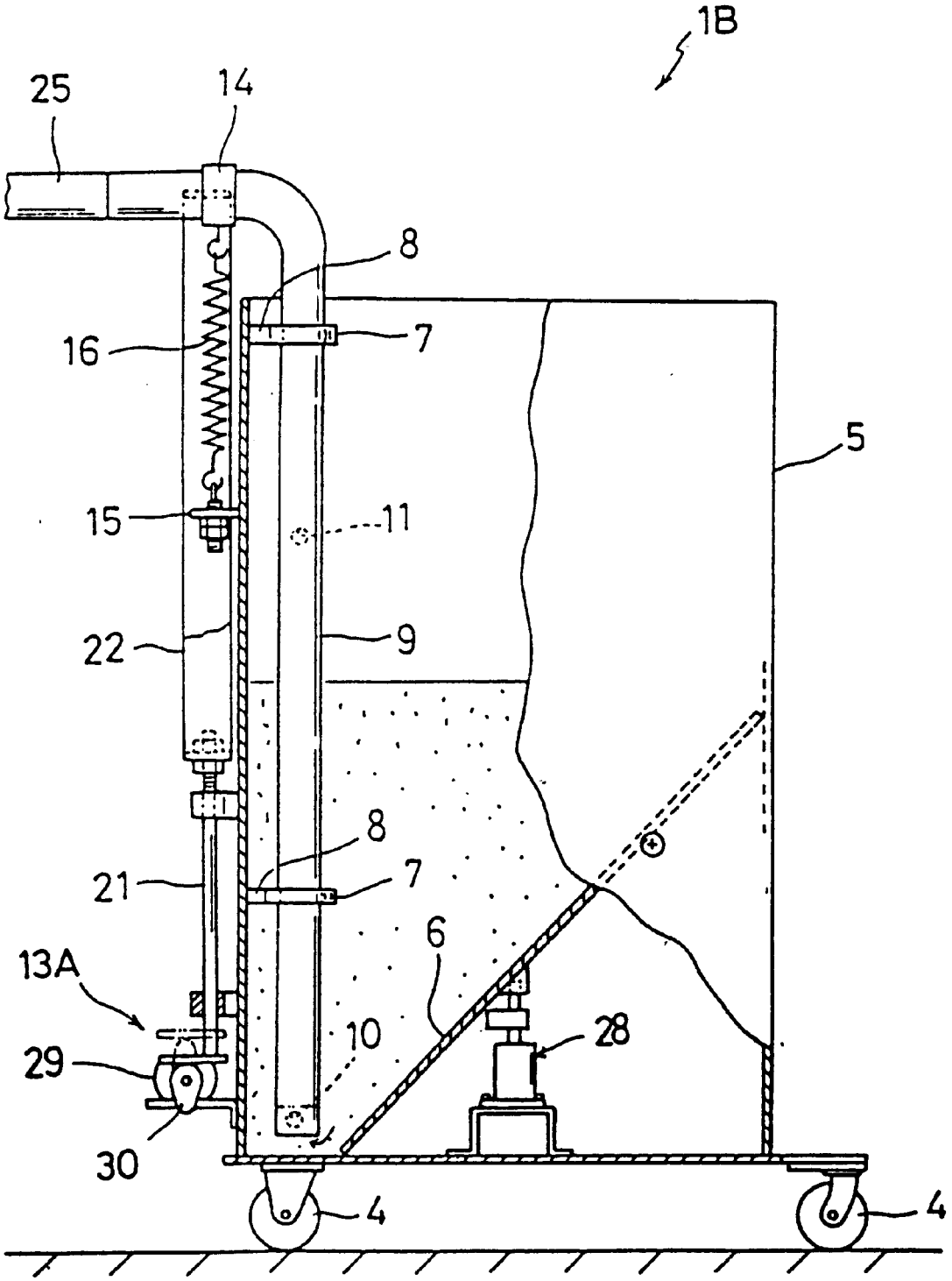
FIG. 9 is a side view in partial cross-section of a feeder according to a third preferred embodiment of the present invention.
Figure 10:
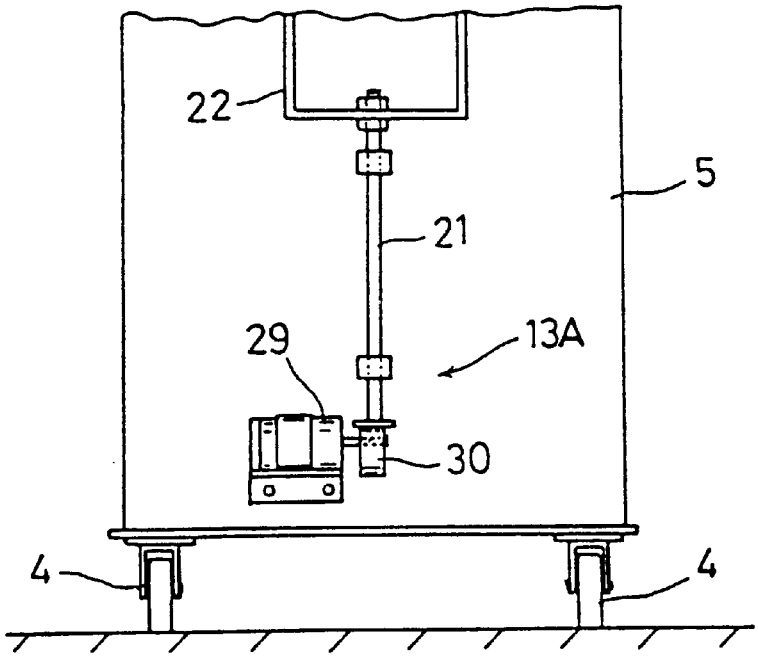
FIG. 10 is a fragmentary, end view of the feeder shown in FIG. 9, partially illustrating the means for reciprocating the suction nozzle.
Figure 11:
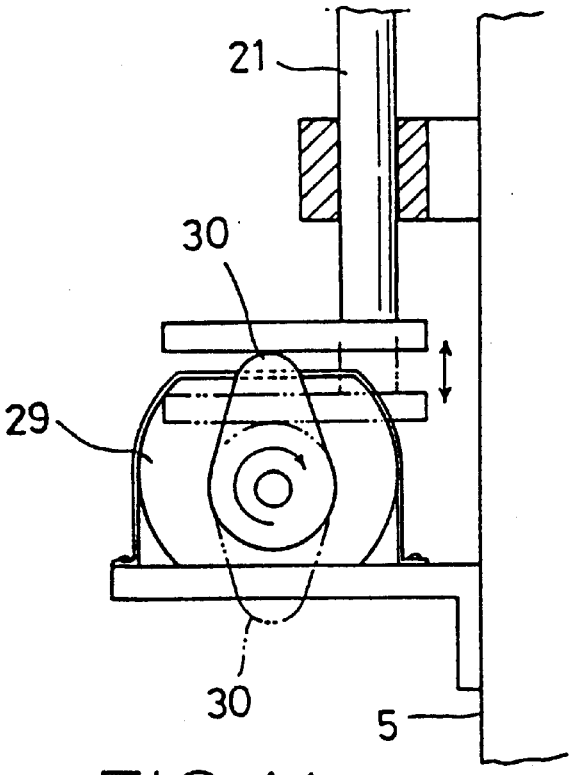
FIG. 11 is an enlarged, fragmentary side view of the reciprocating means shown in FIG. 10.

In a third preferred embodiment of the present invention, as shown in FIGS. 9, 10 and 11, there is included a vibration generator 28 mounted in contact with chute 6 to assist the flow of particles into the discharge area and into the inlet of suction nozzle 9. The third preferred embodiment also includes means 13A for moving suction nozzle 9 relative to the discharge area. Instead of foot pedal 19, means 13A includes motor 29 and cam 30 which vertically moves rod 21 as shown in FIG. 11. As is inherently apparent, the cycle time of the movement of suction nozzle 9 is dependent on the rotational speed of motor 29.

Figure 12:
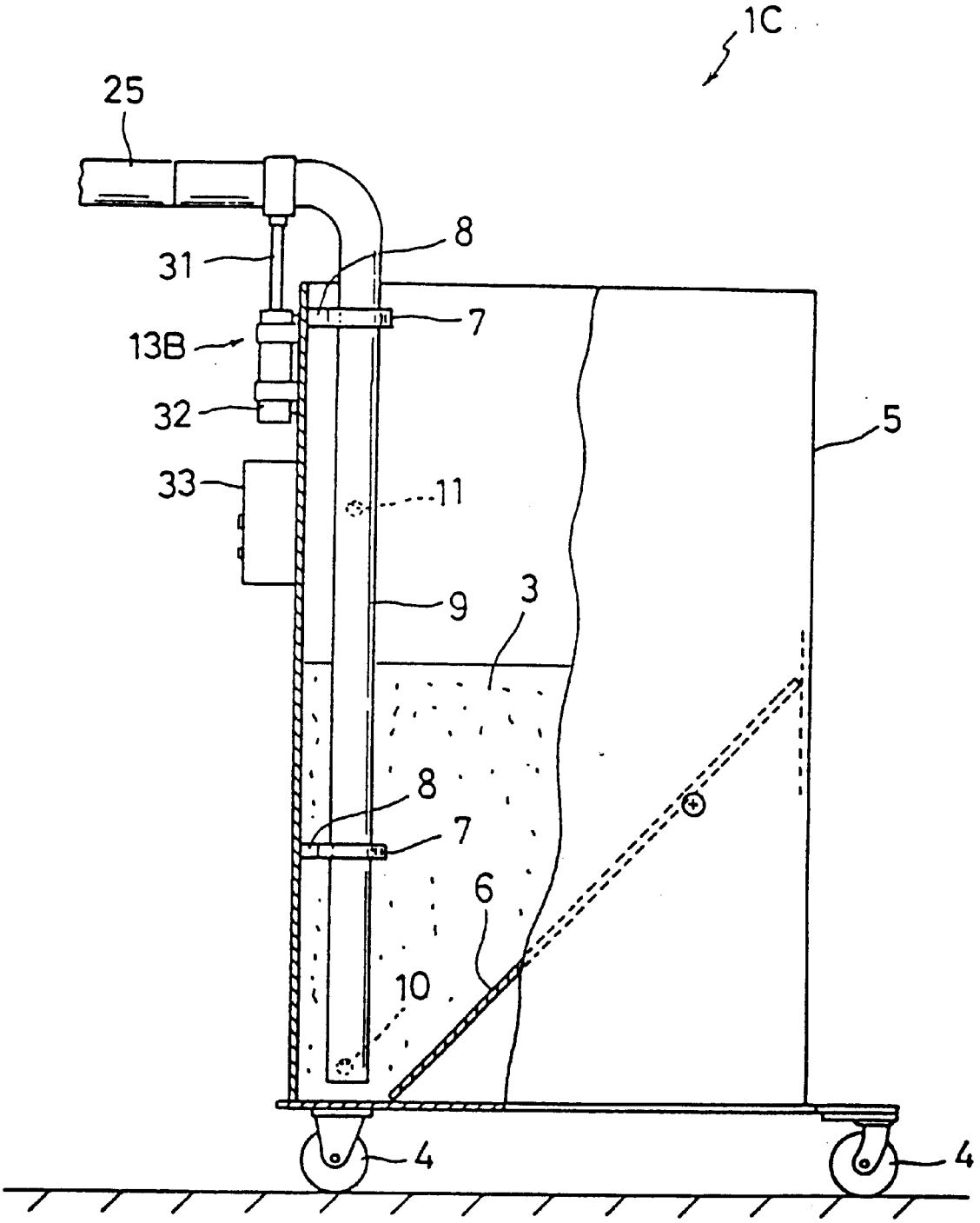
FIG. 12 is a side view in partial cross-section of a feeder according to a fourth preferred embodiment of the present invention.
Figure 13:
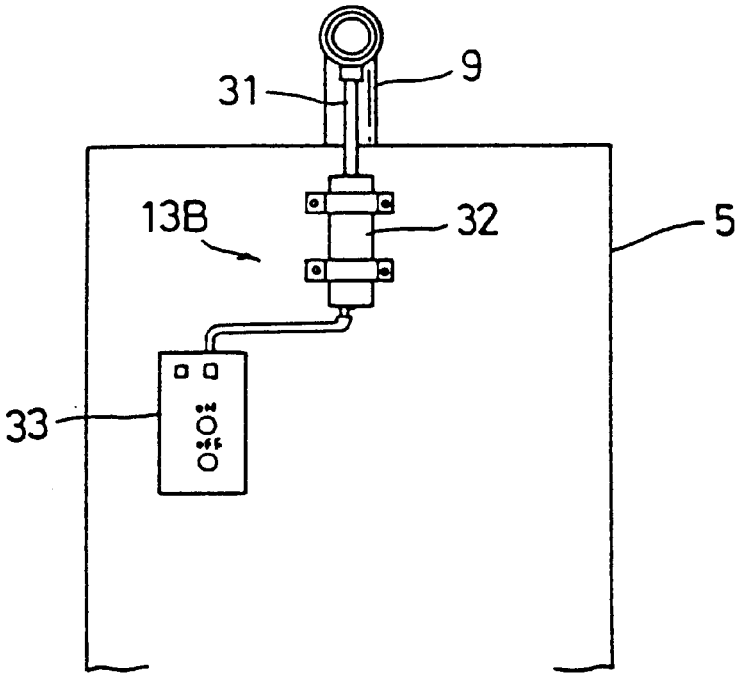
FIG. 13 is a fragmentary, end view of the means for reciprocating the suction nozzle of the feeder shown in FIG. 12.
Figure 14:
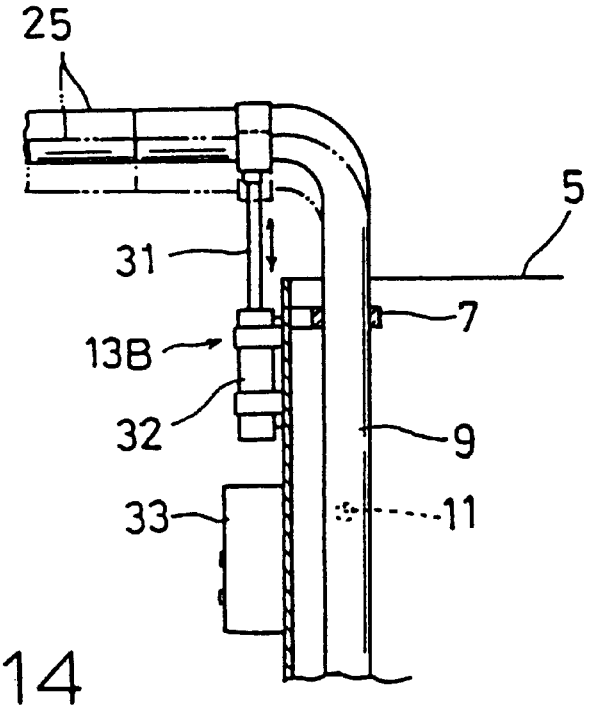
FIG. 14 is a fragmentary, side view of the feeder shown in FIG. 12, showing the means for reciprocating the suction nozzle.

Referring now to FIG. 12, 13, and 14, there is shown a fourth preferred embodiment of the present invention. In this embodiment, means 13B are used for moving suction nozzle 9 with respect to the discharge area. Means 13B include magnetic solenoid 32 which is secured to suction nozzle 9 though operating rod 31. Magnetic solenoid 32 is mounted to feeder 1C and is controlled by control circuit 33 which automatically turns magnetic solenoid on or off. As shown, operating rod 31 moves vertically by the cycling of magnetic solenoid 32, causing suction nozzle 9 to move vertically with respect to the discharge area. By employing means 13B to move suction nozzle 9, similar operations and effects as those described in the first preferred embodiment of the present invention are obtained. In this preferred embodiment, a hydraulic cylinder, an air cylinder or the like can be used in place of magnetic solenoid 32, along with the appropriate control circuit.

Figure 15:
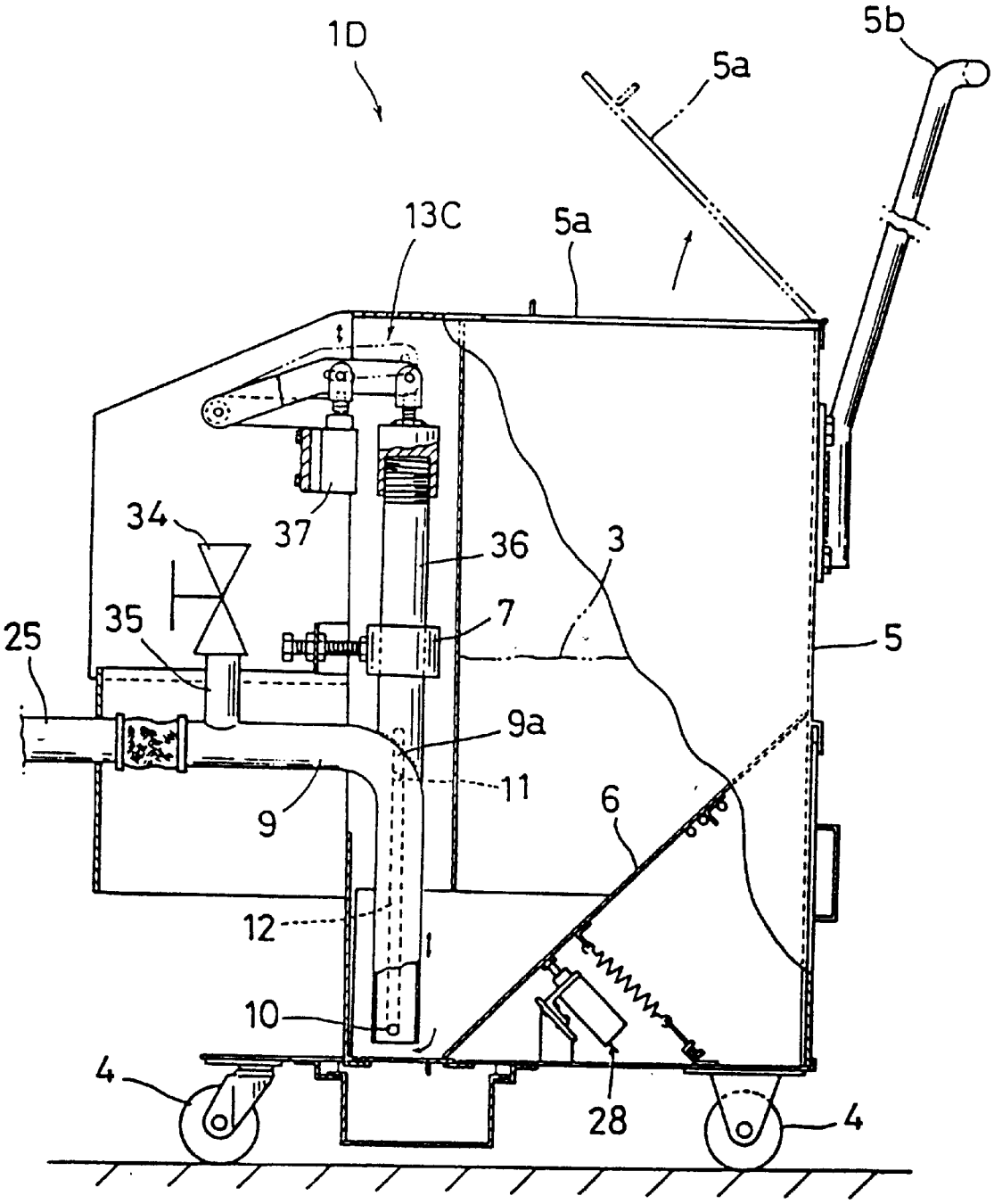
FIG. 15 is a side view in partial cross-section of a feeder according to a fifth preferred embodiment of the present invention.
Figure 16:
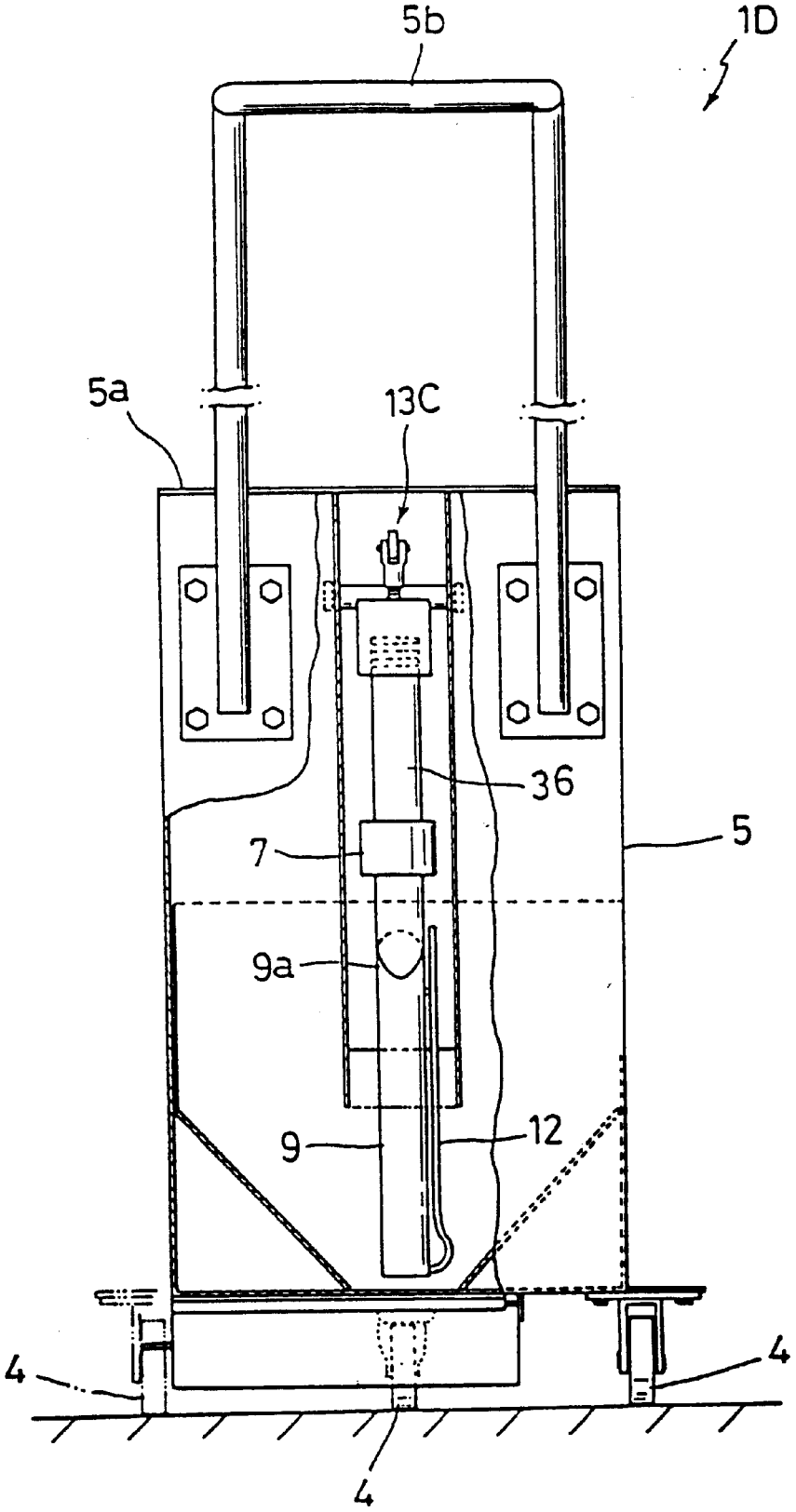
FIG. 16 is an end view, in partial cross-section, of the feeder shown in FIG. 15.
Figure 17:
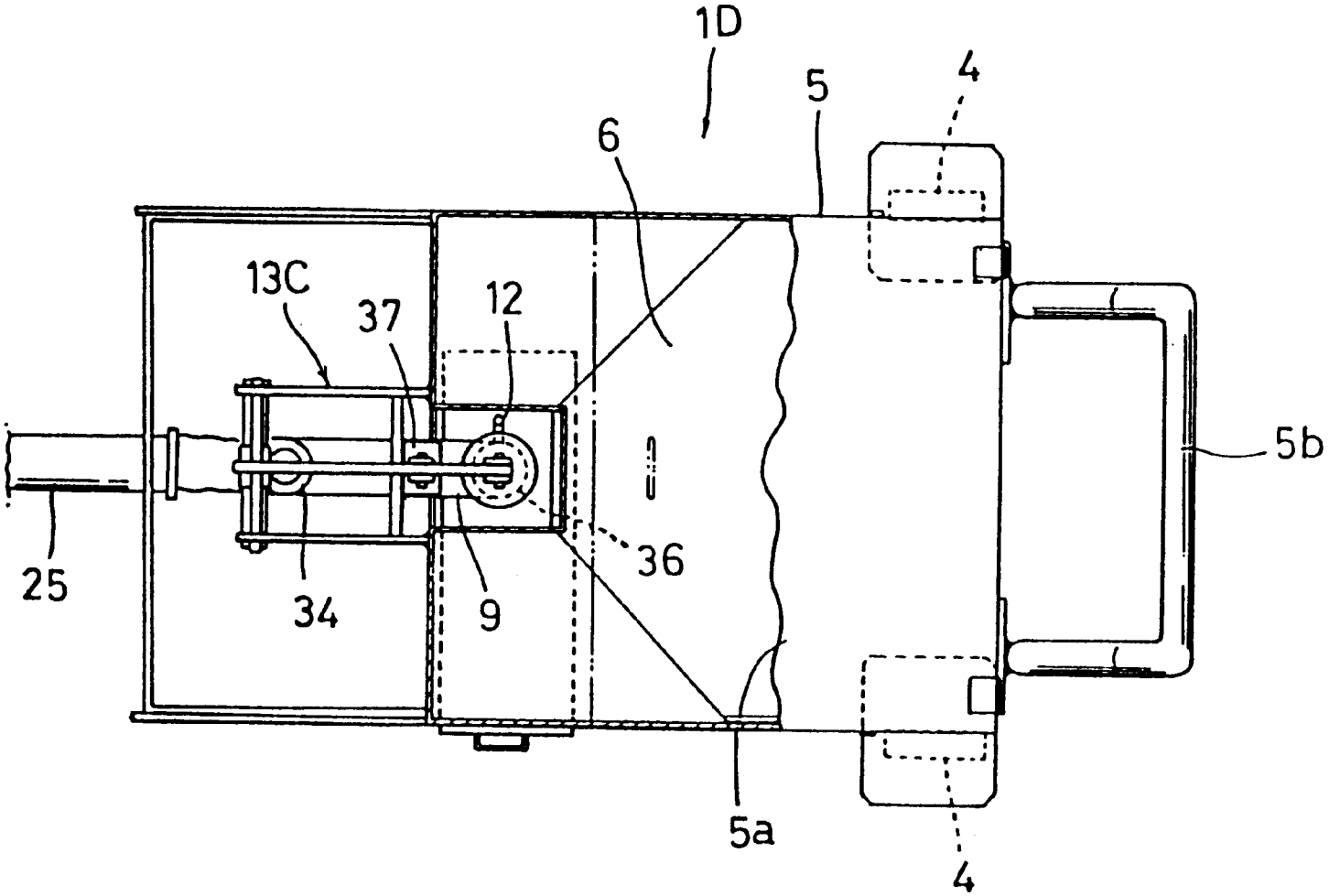
FIG. 17. is a plan view, partially cut away, of the feeder shown in FIG. 15.
Figure 18:
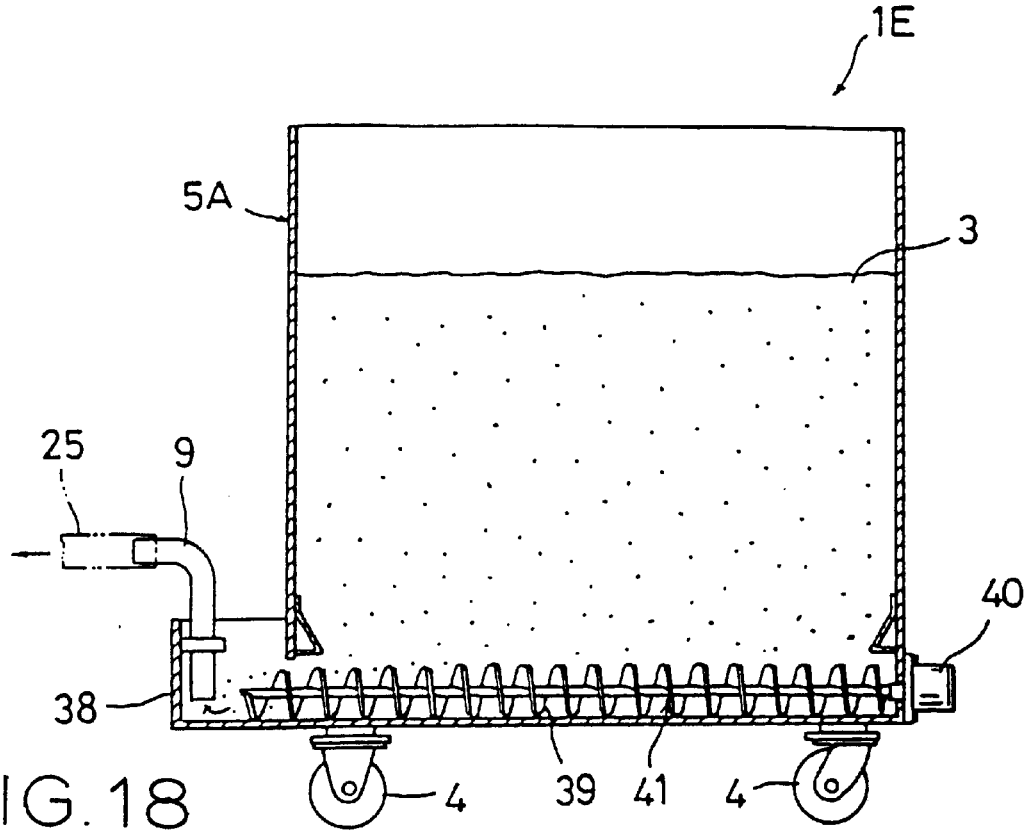
FIG. 18 is a cross-sectional side view of a feeder according to a sixth preferred embodiment of the present invention.

In a fifth embodiment of the present invention shown in FIGS. 15, 16 and 17 suction nozzle 9 extends outside from the nearly central region of container 5. Additionally, container 5 includes lid 5*a* and handle 5*b*. Suction nozzle 9 is slidably secured to feeder 1D by support bar 36 which is connected to corner 9*a* of suction nozzle 9, and which is slidably carried by sleeve 7. Suction nozzle 9 includes air inlet tube 35 and valve 34. By regulating valve 34, the suction capacity or strength present in suction nozzle 9 can be adjusted. As can be appreciated, the particles must be kept from entering sleeve 7 in this embodiment, as well as the other embodiments in order to prevent such interference with the movement of suction nozzle 9. The fifth preferred embodiment includes means 37 for moving suction nozzle 9 with respect to the discharge area.

Figure 19:
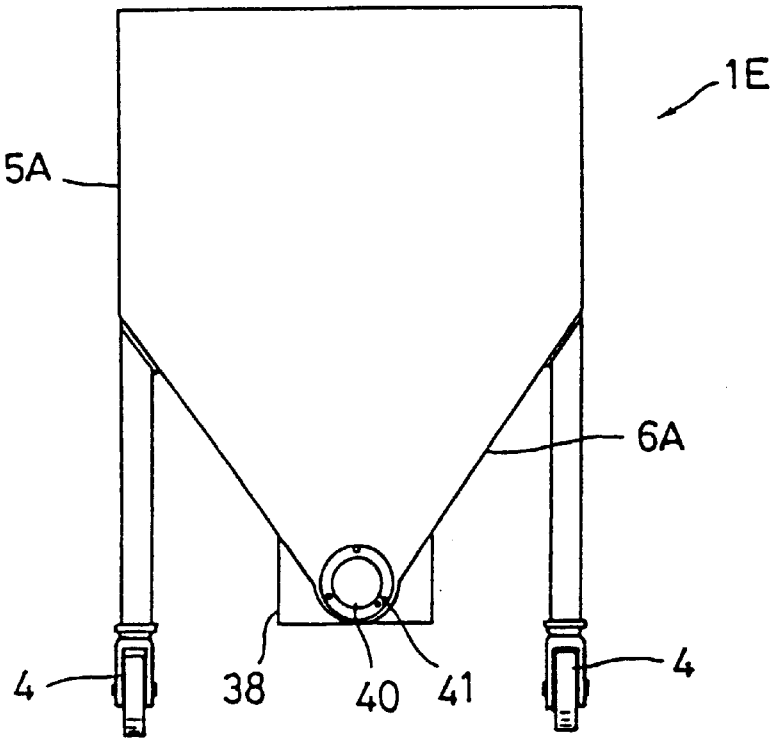
FIG. 19 is a front view of the feeder shown in FIG. 18.
Figure 20:
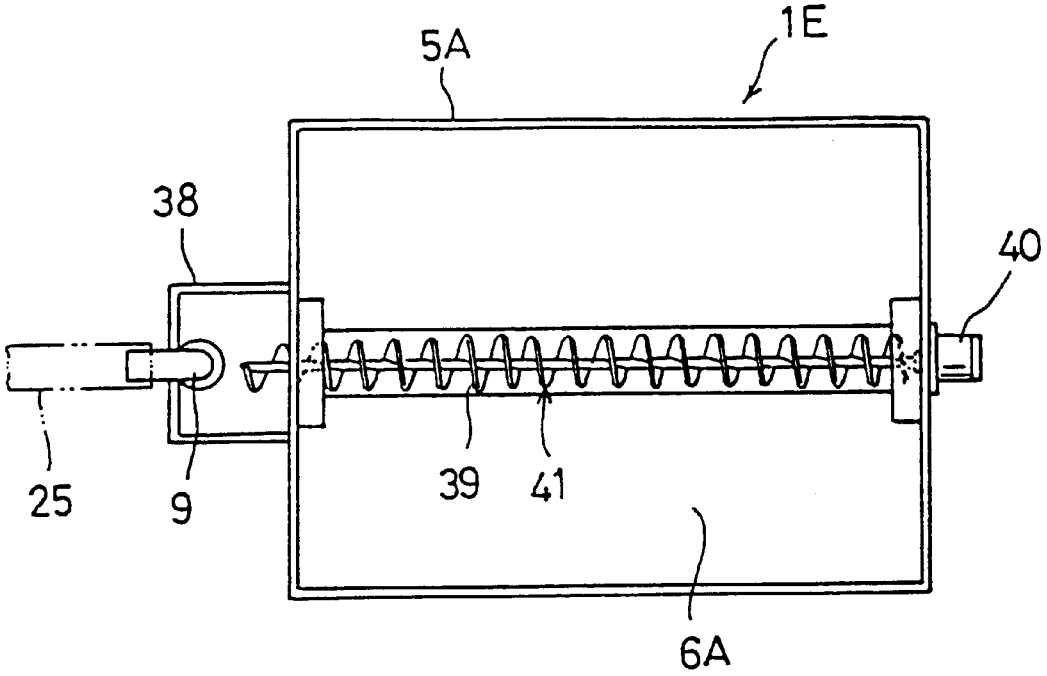
FIG. 20 is a plan view of the feeder shown in FIG. 18 without a top cover.

FIGS. 18–26 illustrate a sixth preferred embodiment of the present invention. In this embodiment, the means associated with container 5A for directing/moving particles disposed therein towards the discharge area 38 (or discharge box 38), includes transfer unit 41 comprising screw 39 disposed at the bottom within container SA in order to feed particles 3 located in container 5A into discharge area or box 38. Motor 40 is attached outside of container 5A in order to turn screw 39. As best seen in FIG. 19, the bottom of container 5A is formed as chute 6A, including two opposing inclined surfaces forming chute 6A converging at the bottom where screw 39 is disposed.

Figure 21:
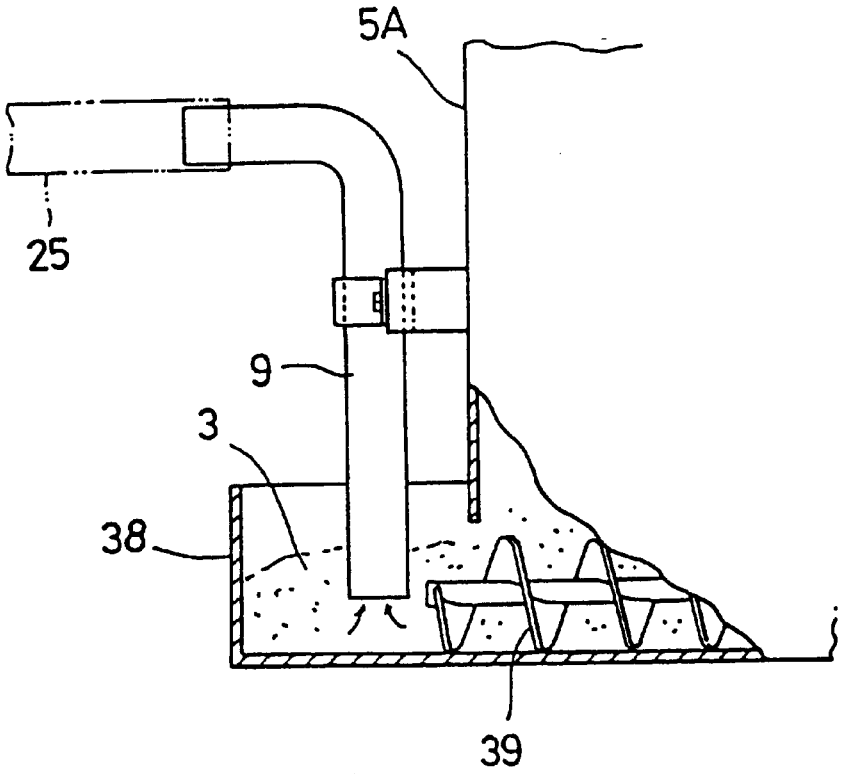
FIG. 21 is a fragmentary enlarged side view, in partial cross-section, showing the discharge area of the feeder shown in FIG. 18.
Figure 22:
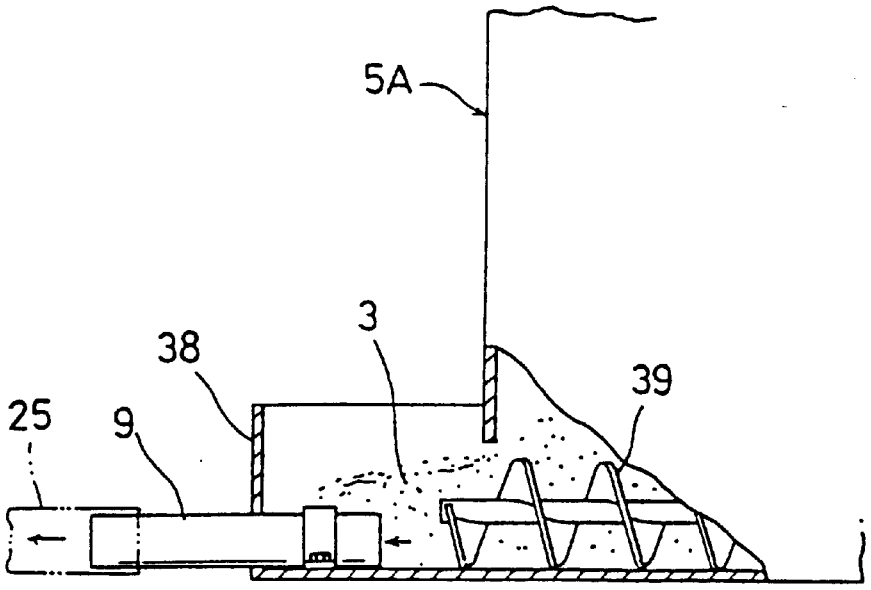
FIG. 22 is a fragmentary enlarged side view, in partial cross-section, showing an alternate design of the discharge area of the sixth preferred embodiment of the present invention.
Figure 23:
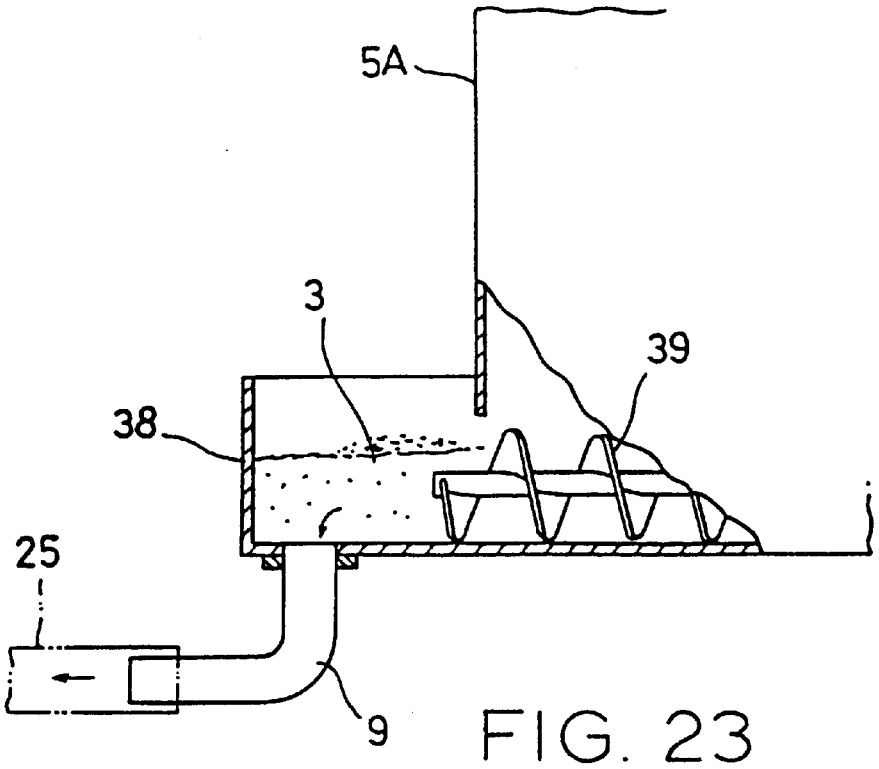
FIG. 23 is a fragmentary enlarged side view, in partial cross-section, showing an alternate design of the discharge area of the sixth preferred embodiment of the present invention.

Suction nozzle 9 can be mounted to container 5A as shown in FIG. 21, extending vertically upward from discharge area or box 38. Alternatively, suction nozzle 9 can also extend horizontally from discharge area or box 38 as shown in FIG. 22 or downwardly as shown in FIG. 23.

Figure 24:
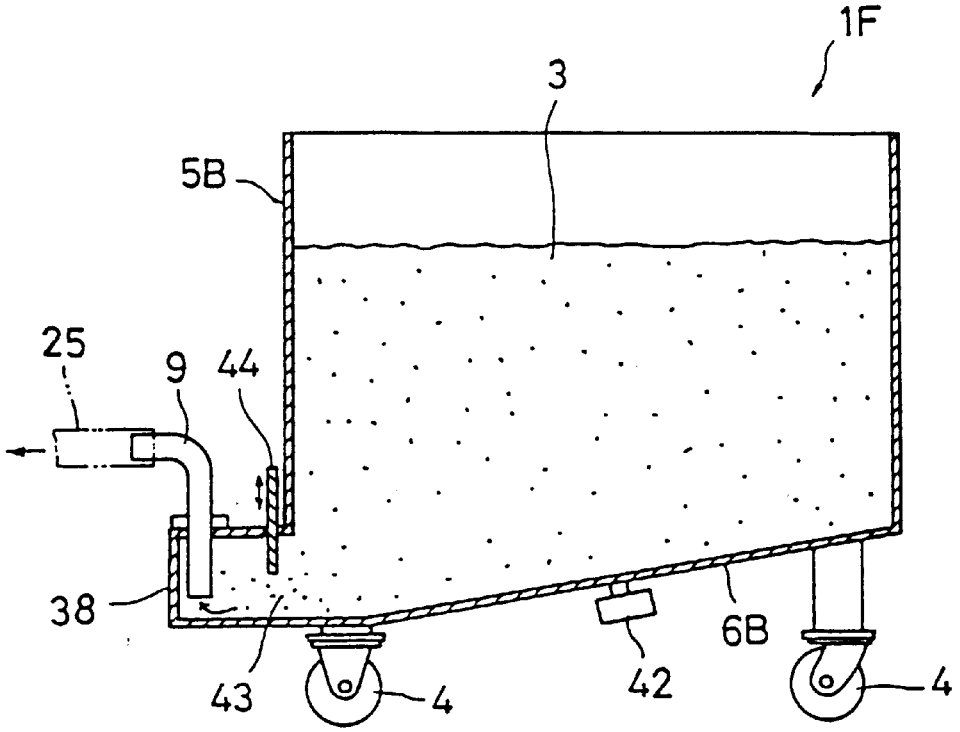
FIG. 24 is a cross-sectional side view of a feeder according to a seventh preferred embodiment of the present invention.
Figure 25:
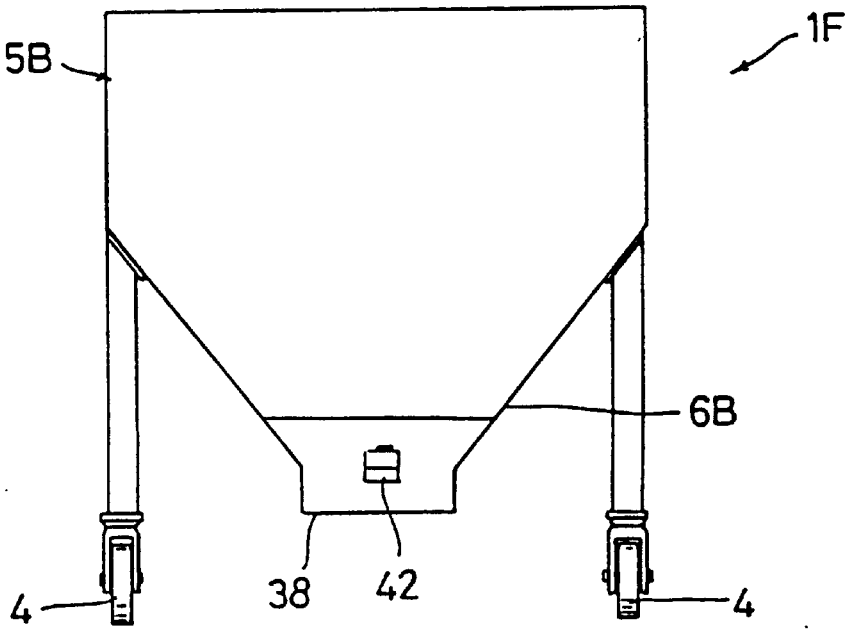
FIG. 25 is a front view of the feeder shown in FIG. 24.
Figure 26:
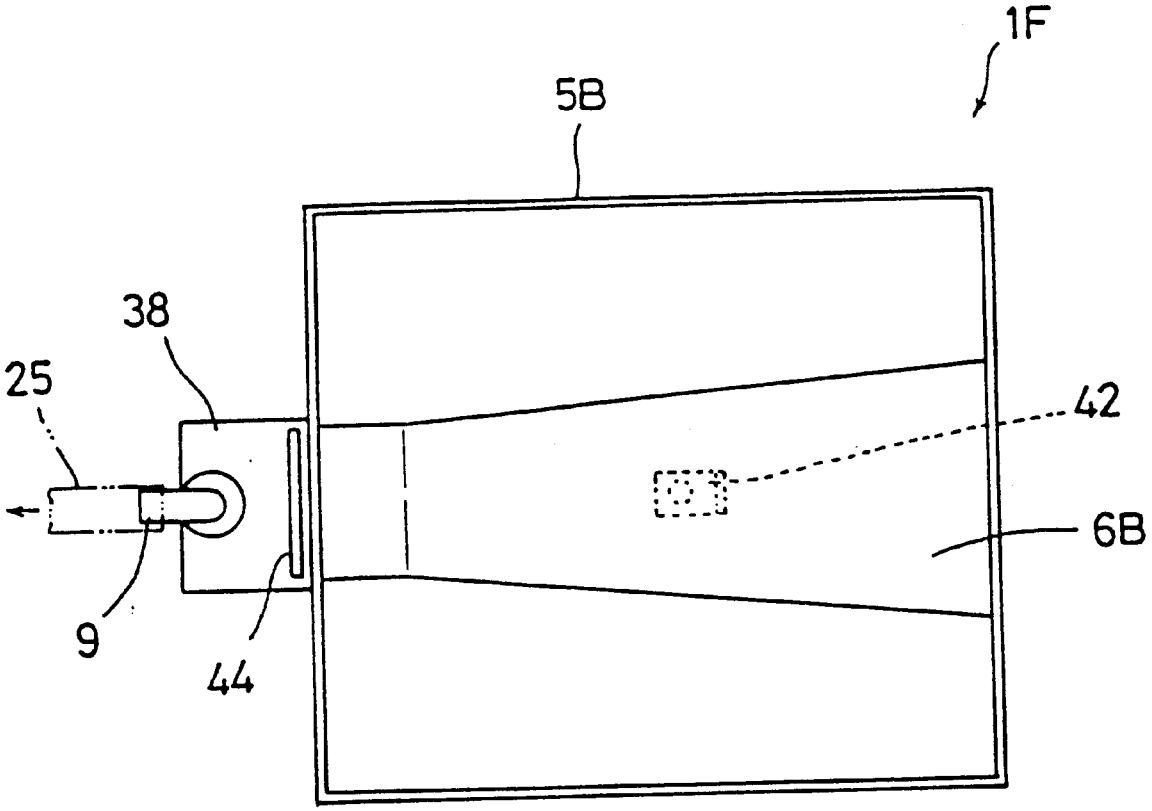
FIG. 26 is a plan view of the feeder shown in FIG. 25, without a cover.

FIGS. 24, 25 and 26 illustrate a seventh preferred embodiment of the present invention. In this embodiment, the means for directing/moving particles 3 toward discharge area or box 38 include inclined chute 6B formed as the lower part of container 5B. As is clear from FIG. 24, 25 and 26, chute 6B is inclined in several different directions generally converging toward the bottom and toward discharge area or box 38. In order to control the flow of particles 3 from container 5B, control valve 44 is used to adjust the size of opening 43 through which particles 3 must pass. Vibrator 42 is mounted on the bottom of chute 6B in order to vibrate the bottom so as to induce particles 3 to flow into discharge area or box 38. Suction nozzle 9 may extend vertically upward as illustrated, or horizontally or downwardly from discharge area or box 38 as previously described with respect to the sixth preferred embodiment. It should be understood, that means for moving suction nozzle 9 with respect to the discharge area may be included regardless of the specific orientation or configuration of suction nozzle 9.

Figure 27:
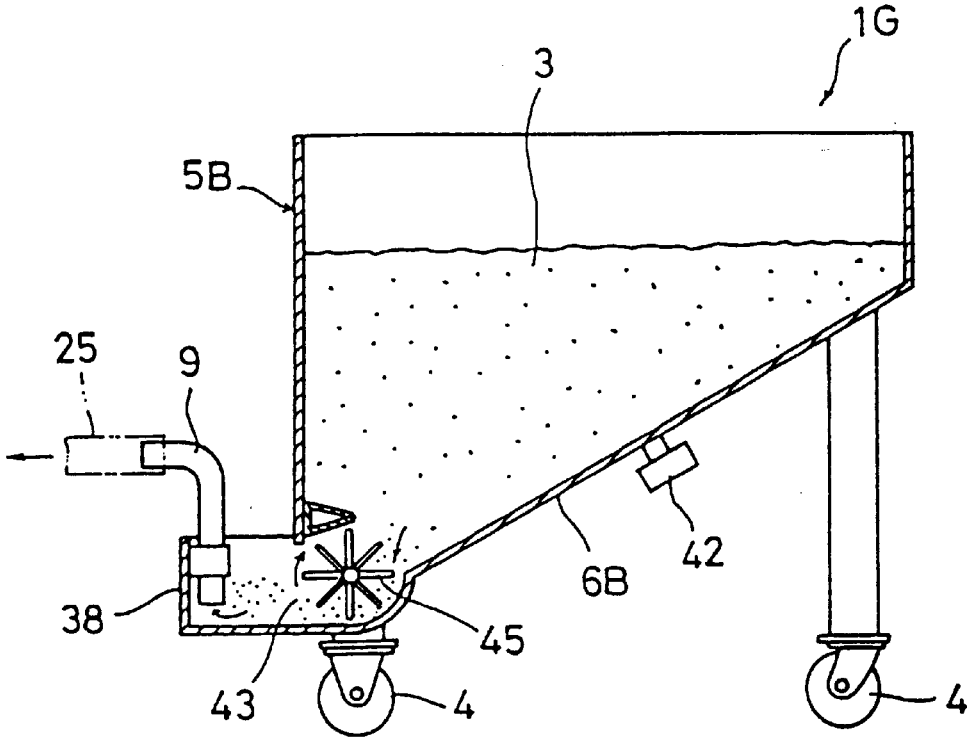
FIG. 27 is a cross-sectional side view of a feeder according to an eighth preferred embodiment of the present invention.
Figure 28:
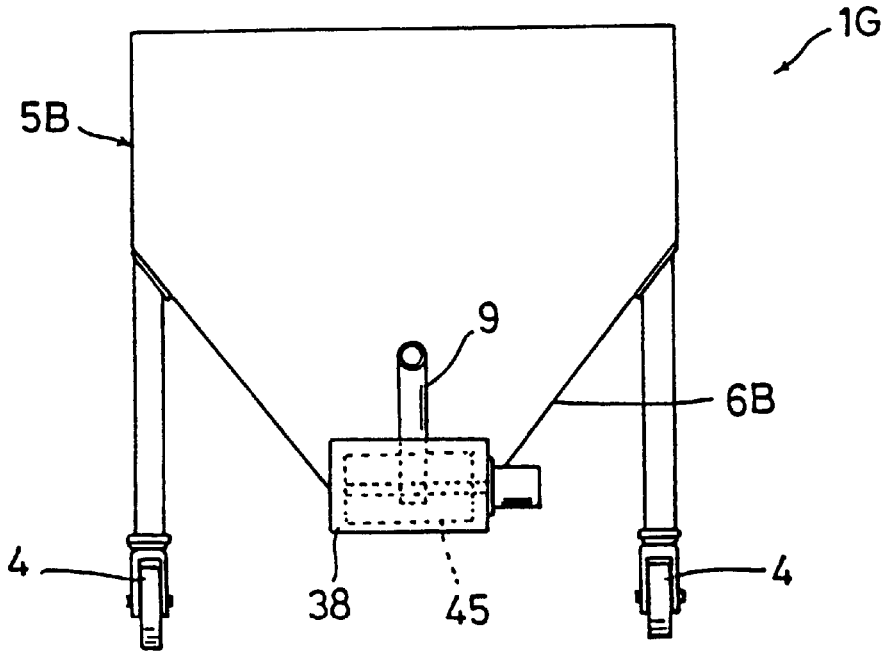
FIG. 28 is a front view of the feeder shown in FIG. 27.
Figure 29:
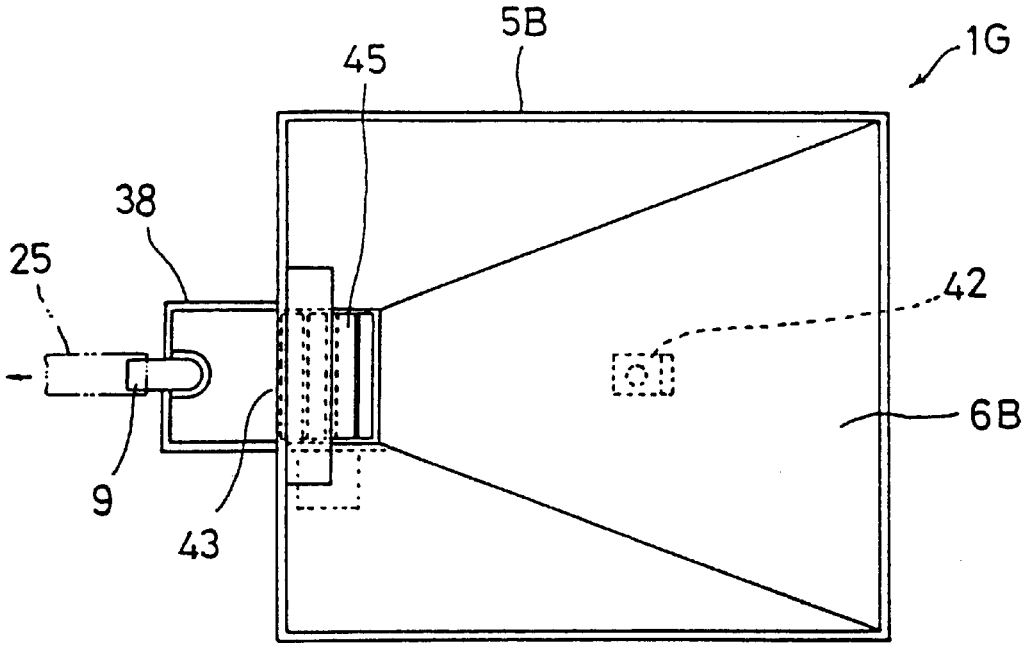
FIG. 29 is a plan view of the feeder shown in FIG. 27, without a cover.
Figure 30:
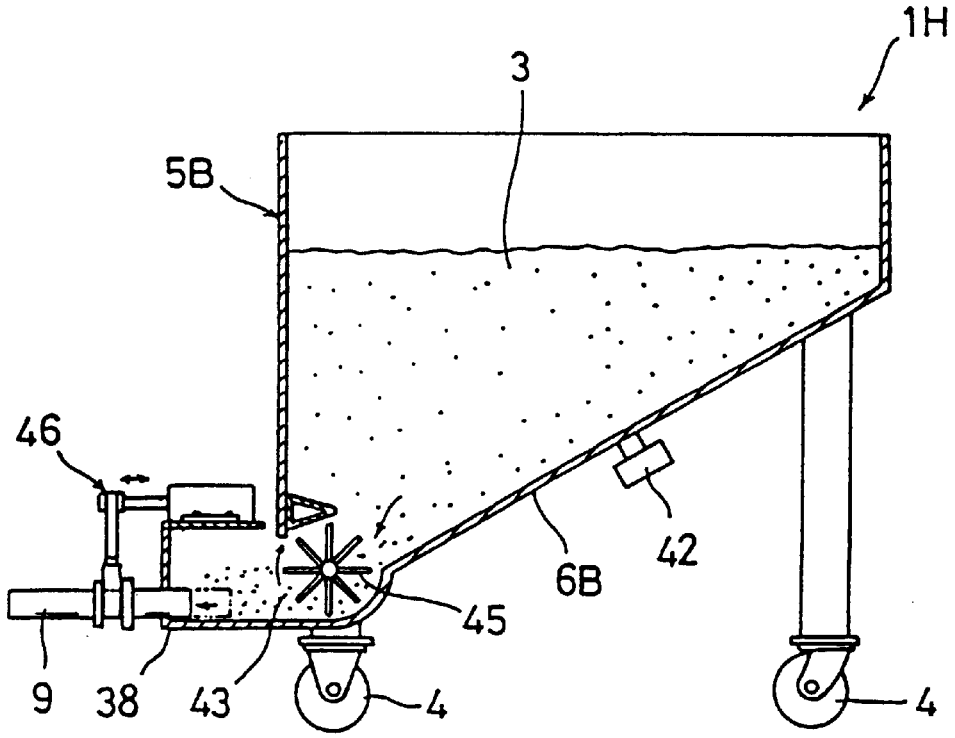
FIG. 30 is a cross-sectional side view of a feeder according to a ninth preferred embodiment of the present invention.
Figure 31:
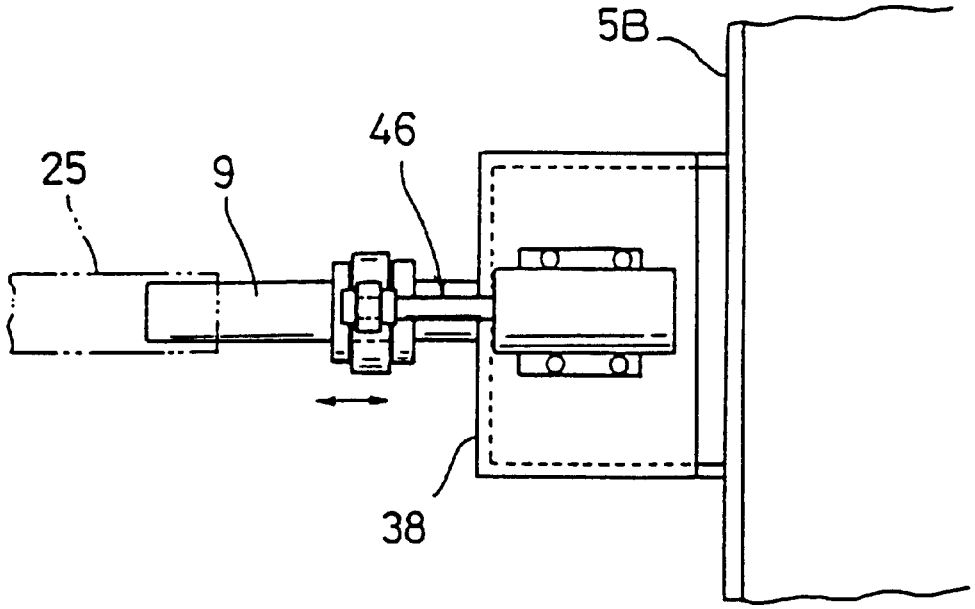
FIG. 31 is a fragmentary enlarged plan view of the means for reciprocating the suction pipe of the feeder shown in FIG. 30.
Figure 32:
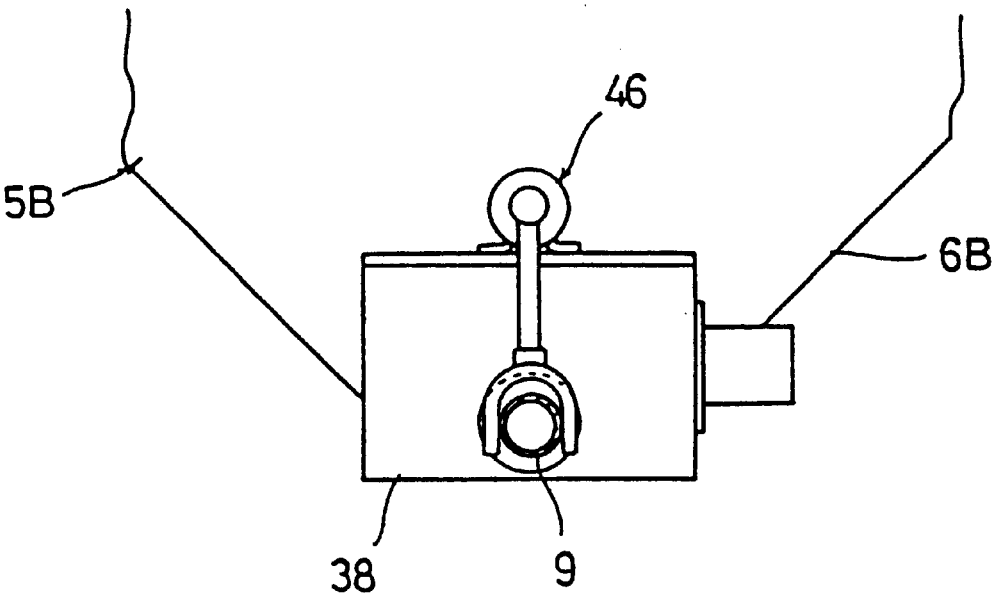
FIG. 32 is a fragmentary enlarged front view of the reciprocating means illustrated in FIG. 31.

FIGS. 27, 28 and 29 illustrate an eighth preferred embodiment of the present invention. In this embodiment, feeder 1G includes rotary valve 45 fitted to opening 43. Again, the orientation of suction nozzle 9 is not limited to the specific orientation illustrated in FIG. 27. In a ninth preferred embodiment of the present invention, as shown in FIGS. 30, 31 and 32, suction nozzle 9 is mounted on the side of the discharge area or box 38 so as to move horizontally with respect to discharge area or box 38. Means 46 are included for moving suction nozzle 9 with respect to discharge area or box 38. As shown in FIG. 30, this movement is generally horizontally.

Figure 33:
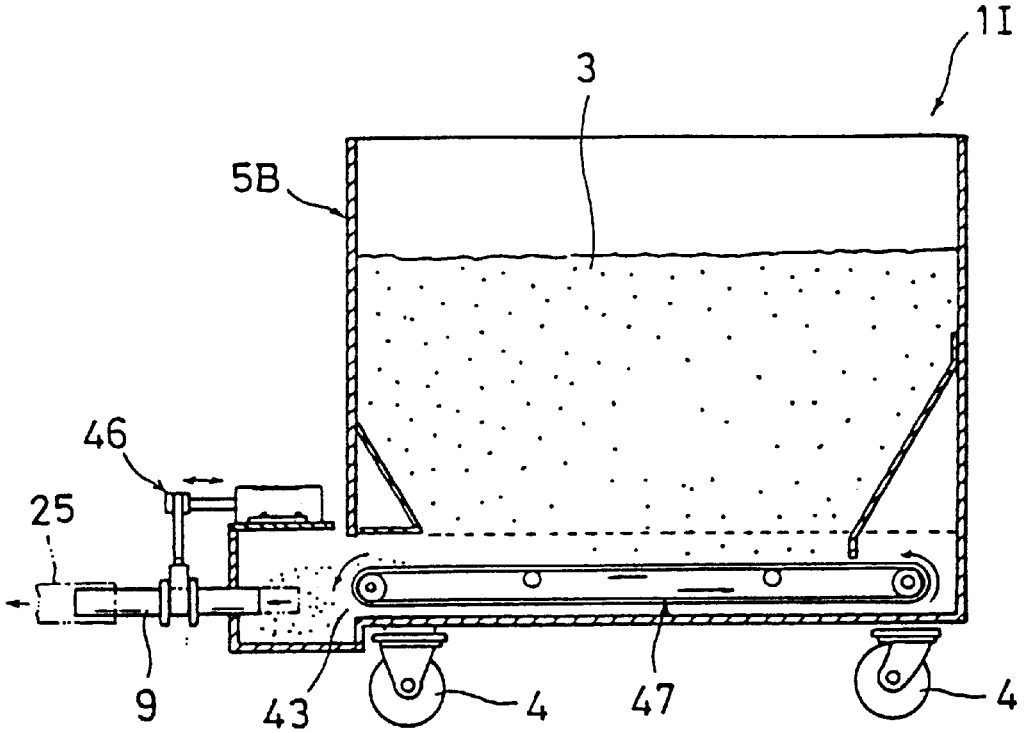
FIG. 33 is a cross-sectional side view of a feeder according to a tenth preferred embodiment of the present invention.
Figure 34:
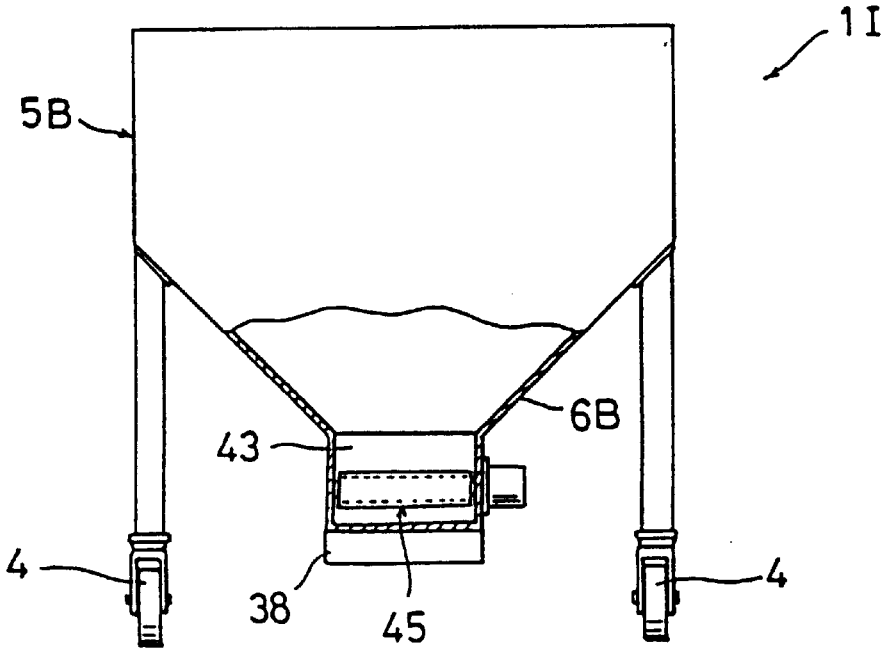
FIG. 34 is a front view, in partial cross-section, of the feeder shown in FIG. 33.
Figure 35:
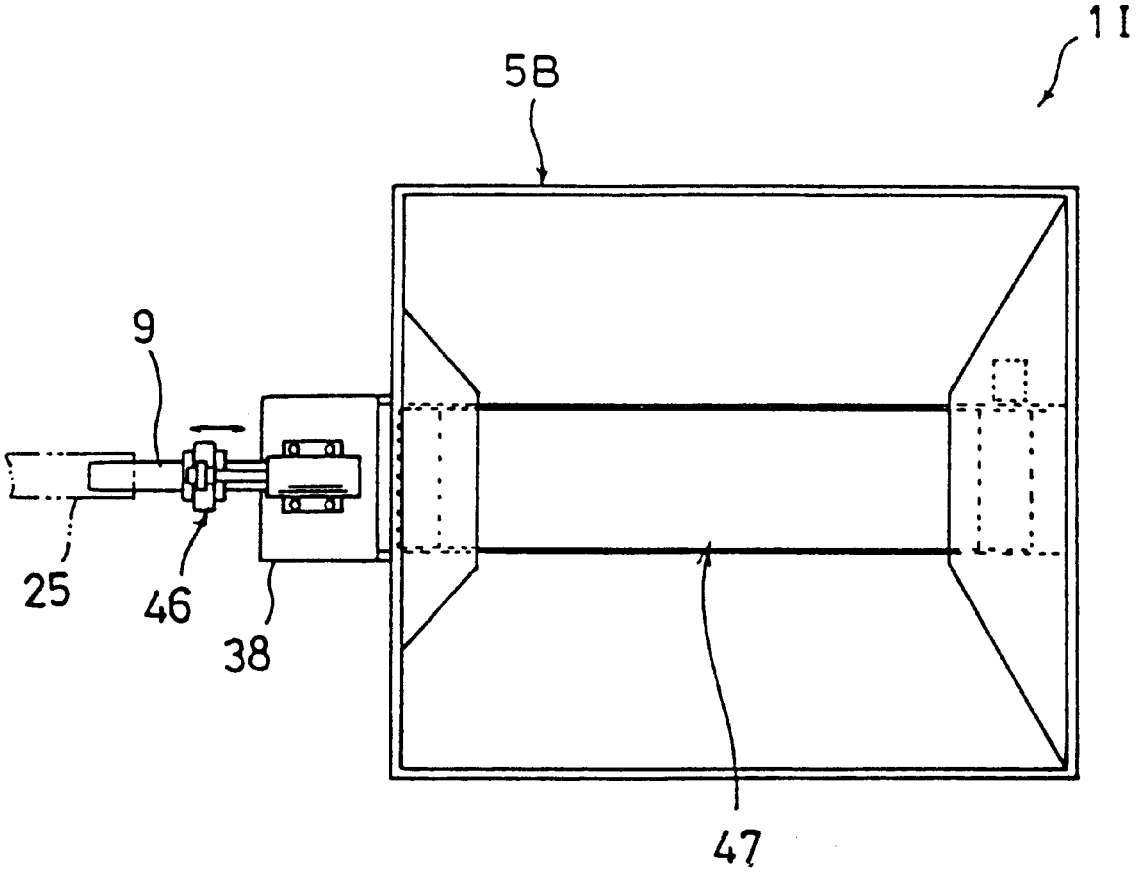
FIG. 35 is a plan view of the feeder shown in FIG. 33, without a cover.

Referring now to FIGS. 33, 34 and 35, a tenth preferred embodiment of the present invention is illustrated therein. In this embodiment, the means for directing/moving particles 3 toward discharge area or box 38 includes conveyor belt 47 disposed at the bottom of chute 6B. In feeder 11, as illustrated in FIGS. 33–35, operations and effects can be obtained similar to those described in the ninth preferred embodiment, as well as previous preferred embodiments of the present invention.

Figure 36:
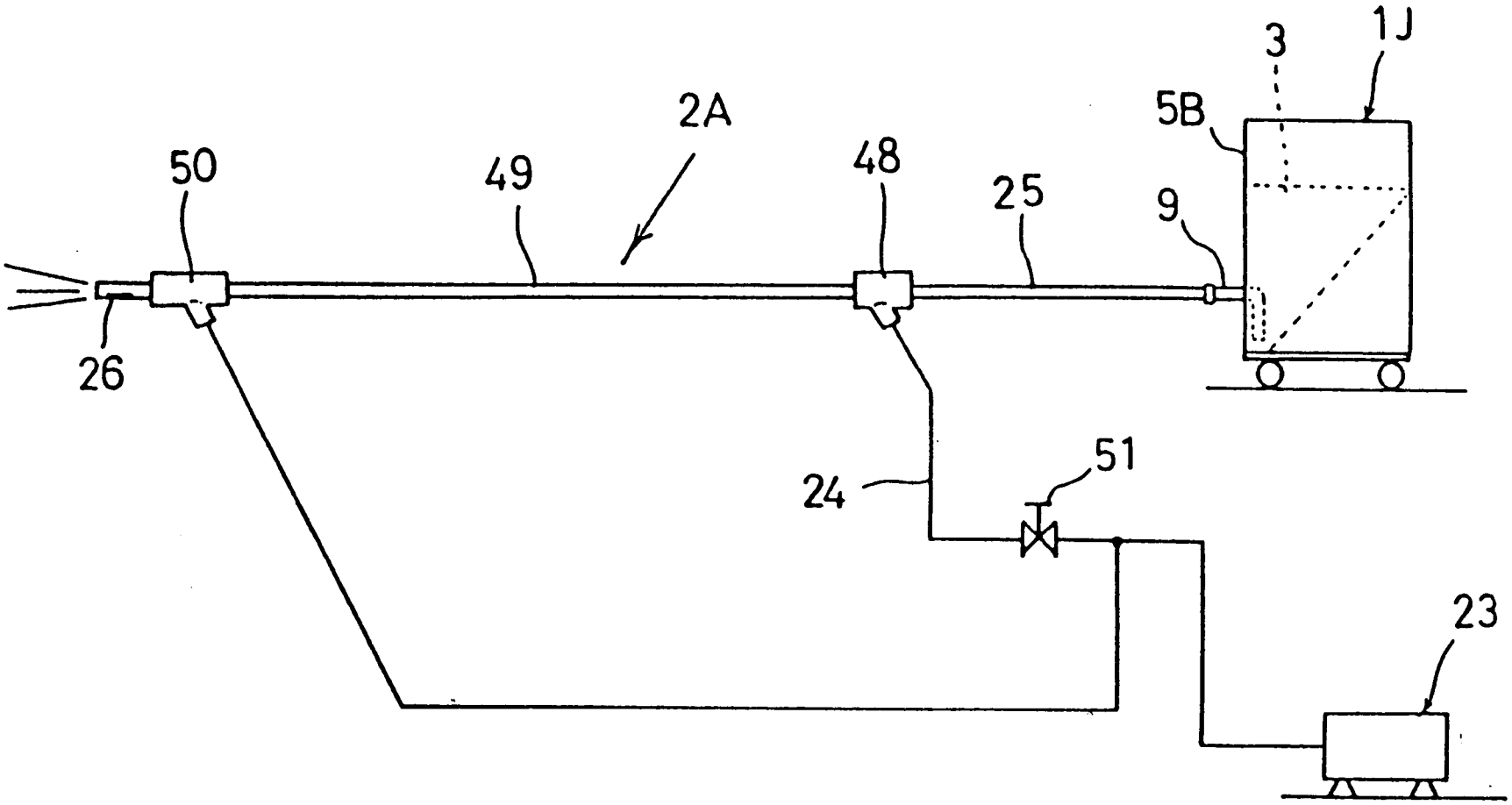
FIG. 36 is a diagrammatic view generally showing a partial blast feeding apparatus according to an eleventh preferred embodiment of the present invention.
Figure 37:
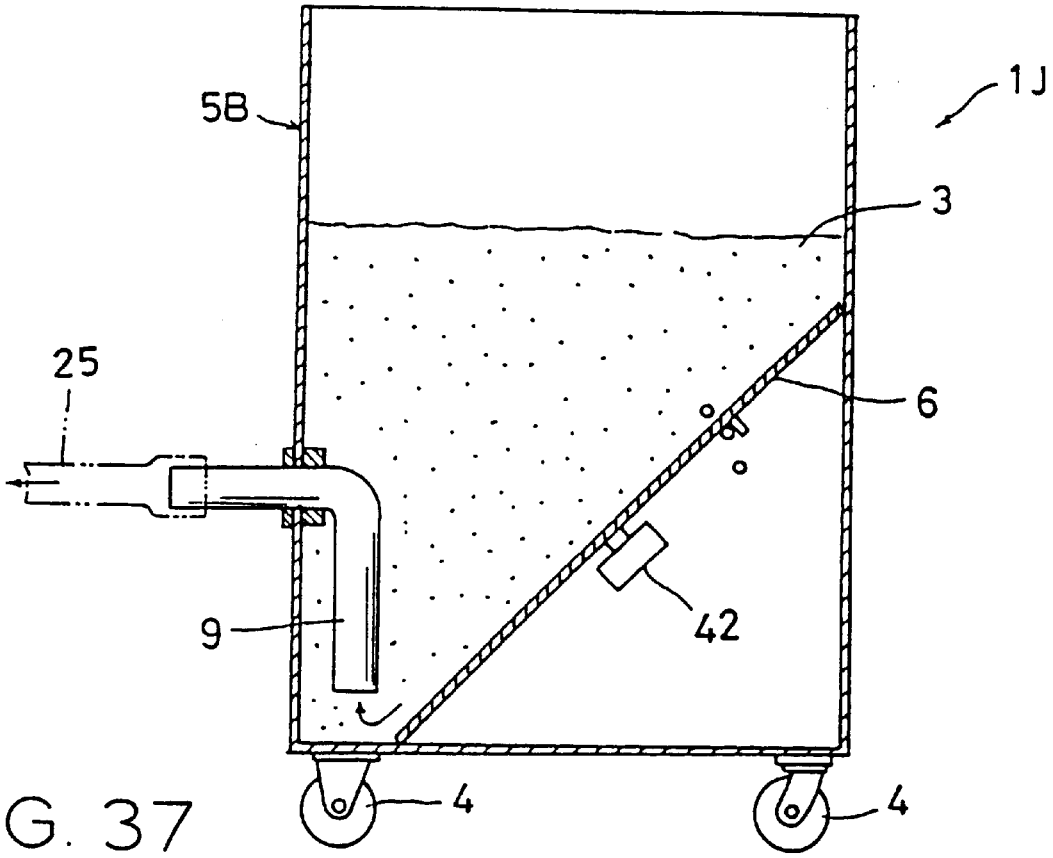
FIG. 37 is a cross-sectional side view of a feeder according to an eleventh preferred embodiment of the present invention.
Figure 38:
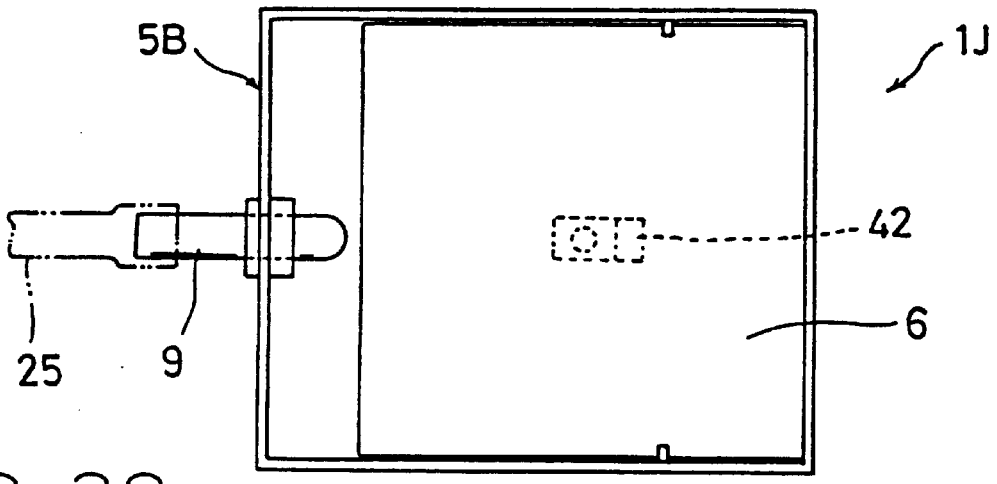
FIG. 38 is a plan view of the feeder shown in FIG. 37, without a cover.

FIGS. 36, 37 and 38 illustrates an eleventh preferred embodiment of the present invention. As illustrated in FIGS. 36, the particle blast cleaning apparatus of this embodiment incorporates first and second ejectors 48 and 50, respectively. First ejector 48 is connected with air supply hose 24 which is regulated through pressure compensated flow control valve 51 such that first ejector 48 has less "suction power" than second ejector 50. As shown in FIG. 37, feeder 1J does not include a separate discharge box, such that particles 3 are aspirated into suction nozzle 9 as a result of the air flow through first ejector 48.

Figure 39:
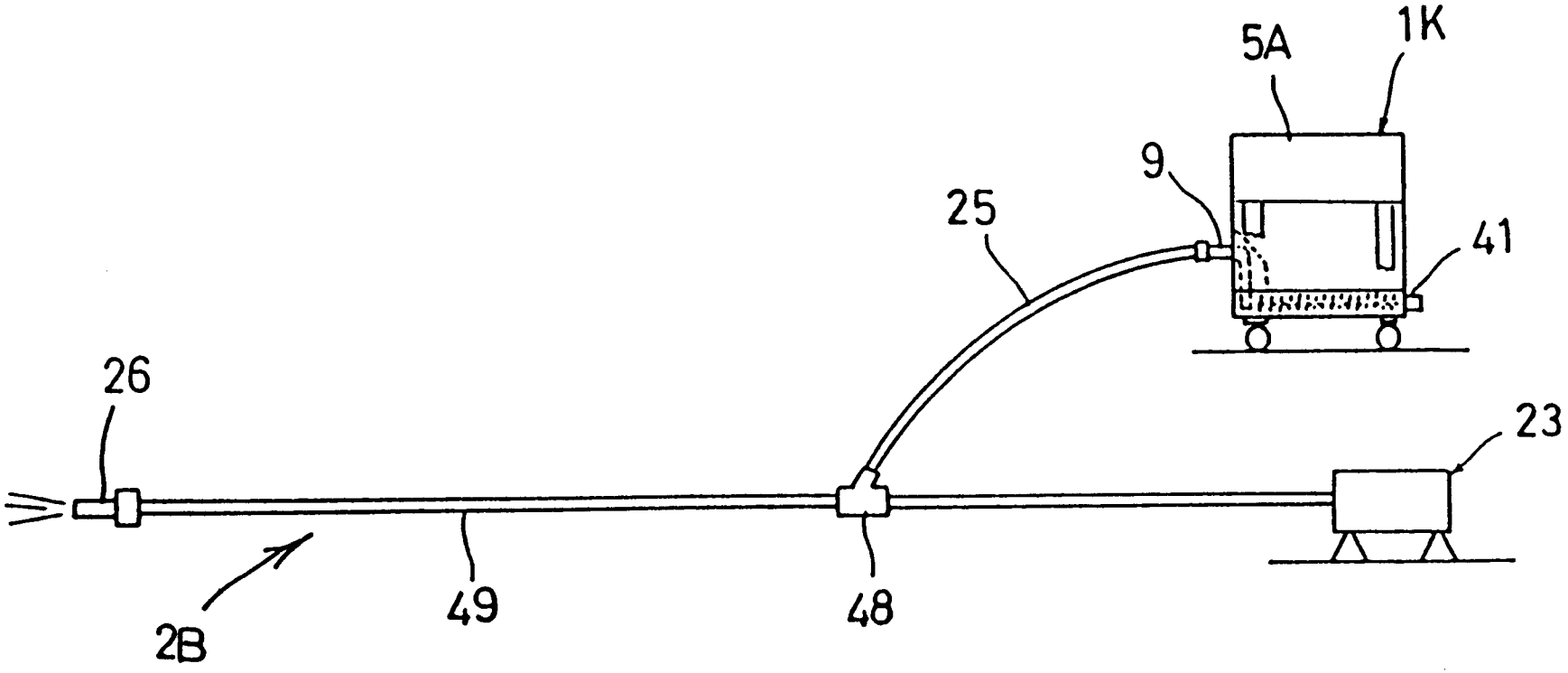
FIG. 39 is a diagrammatic view generally showing a partial blast feeding apparatus according to a twelfth preferred embodiment of the present invention.
Figure 40:
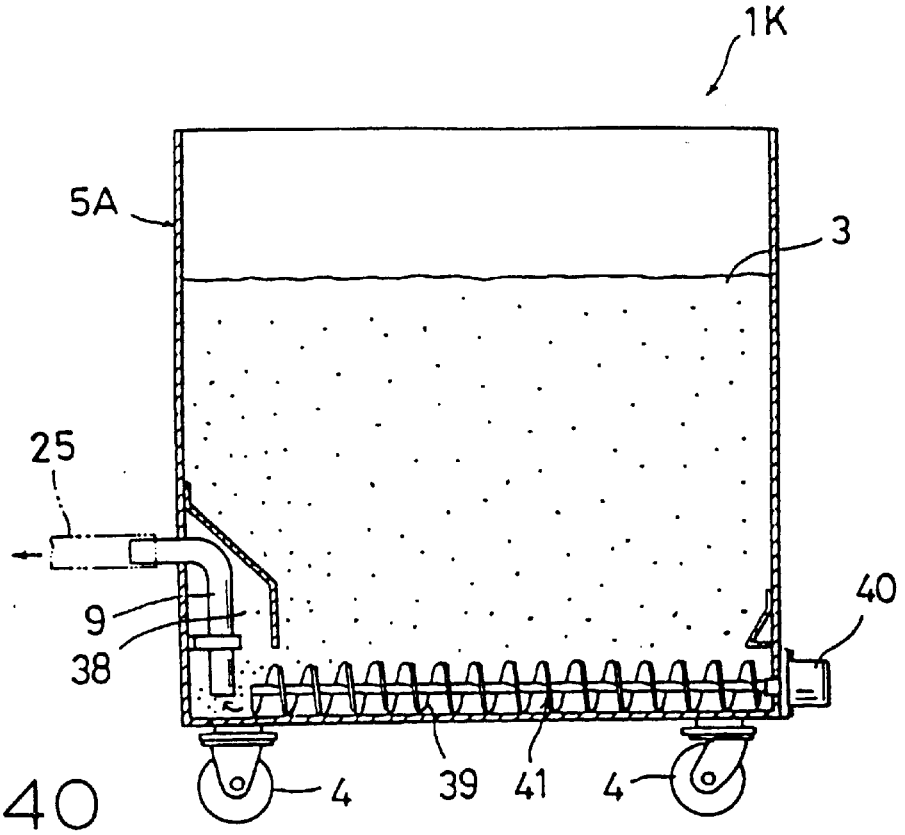
FIG. 40 is a cross-sectional side view of a feeder according to the twelfth preferred embodiment of the present invention.
Figure 41:
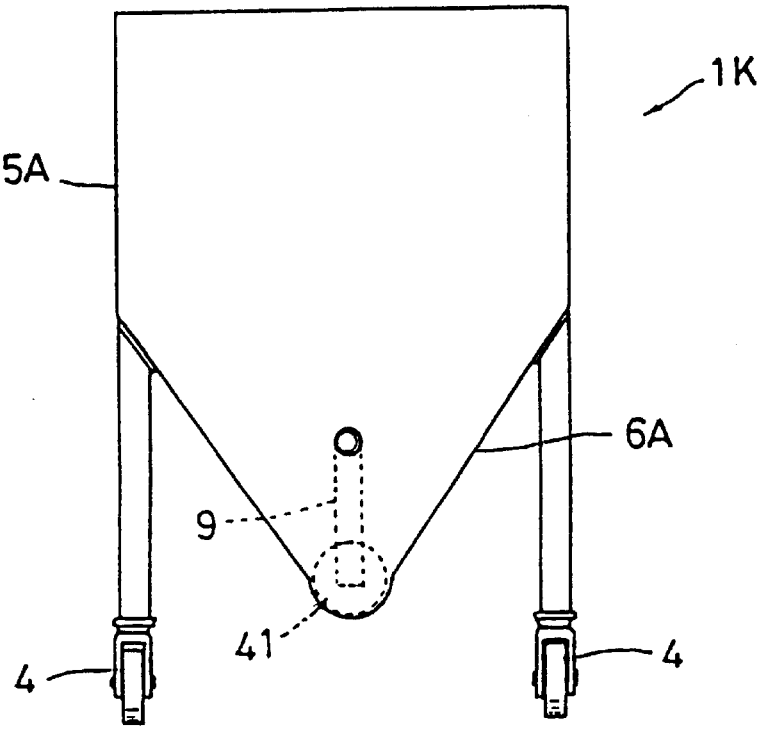
FIG. 41 is a front view of the feeder shown in FIG. 40.

Referring now to FIGS. 39, 40 and 41 there is shown a twelfth preferred embodiment of the present invention. In this embodiment, feeder 1K and suction unit 2B are utilized, which includes hose 49 between ejector 48 and nozzle 26. Hose 49 allows the user to get nozzle 26 into areas that nozzle 26 and ejector 48, as shown in FIG. 1, could not reach. Feeder 1K includes container 5A with discharge box 38 arranged therein. With such construction, the operation and effects thereof are similar to those of the other preferred embodiments.

In summary, numerous benefits have been described which result form employing the concepts of the invention. A wide variety of particles may be used, in particular, carbon dioxide pellets. In addition, material which maintain fluid characteristics, either in powder or granular form, can be used. As described above, several different means for directing/moving the particles toward the discharge area can be used, such as a chute which directs the particles to the center bottom of the containing vessel. Although the suction tube is primarily illustrated as being reciprocated vertically, it may be moved in numerous different orientations, some of which are specifically set forth herein. For example, the suction nozzle may be inclined. Although the nozzle is described as a suction nozzle, different methods of aspiration are contemplated by the invention.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A feeder for transporting particles, comprising:

(a) a container for receiving particles, said container having a discharge area as part thereof;

(b) a suction nozzle having an inlet end disposed adjacent said discharge area, said suction nozzle having an axis; and (c) means for creating relative motion between said inlet end and said discharge area, said motion being repetitive and bidirectional along said axis.

2. The device as claimed in claim 1, comprising means for directing or moving particles disposed within said container toward said discharge area.

3. The device as claimed in claim 2, wherein said means for directing or moving particles includes a screw disposed in said container so as to move said particles toward said discharge area.

4. The device as claimed in claim 2, wherein said means for directing or moving particles includes a conveyor belt disposed in said container so as to move said particles towards said discharge area.

5. The device as claimed in claim 1, wherein said inlet end is disposed within said container.

6. The device as claimed in claim 1, wherein at least a portion of said suction nozzle is disposed within said container.

7. The device of claim 1 wherein said means reciprocates said inlet end.

8. A particle blast apparatus, comprising:

(a) a discharge nozzle;

(b) at least one ejector nozzle which is connectable to a source of compressed gas, said at least one ejector nozzle being in fluid communication with said discharge nozzle;

(c) a feeder comprising:

(i) a container for receiving particles, said container having a discharge area;

(ii) a suction nozzle having an inlet end disposed adjacent said discharge area, said suction nozzle having an axis, said suction nozzle being in fluid communication with said at least one ejector nozzle; and (iii) means for creating relative motion between said inlet end and said discharge area, said motion being repetitive and bidirectional alone said axis.

9. A method of delivering particles to a discharge nozzle, comprising the steps of:

(a) providing a source of particles;

(b) providing a suction nozzle which is in fluid communication with said discharge nozzle, said suction nozzle having an axis, said suction nozzle having an inlet end;

(c) moving said particles toward a discharge area;

(d) moving said inlet end relative to said discharge area repetitively and bidirectionaly along said axis;

(e) aspirating said particles into said suction nozzle; and (f) conveying said particles through a supply line which fluidly connects said discharge nozzle to said suction nozzle.

10. A feeder for transporting particles, comprising:

(a) a container for receiving particles, said container having a discharge area;

(b) a suction nozzle having an inlet end disposed adjacent said discharge area, said suction nozzle having an axis, said inlet end being movable relative to said discharge area repetitively and bidirectionally along said axis.

11. The device of claim 10, wherein said inlet end is disposed within said container.

12. The device of claim 10, wherein at least a portion of said suction nozzle adjacent said inlet end is disposed generally vertically.

13. The device of claim 10, wherein said inlet end is reciprocal vertically relative to said discharge area.

14. The device of claim 10, wherein said suction nozzle is disposed between 45 degrees and 90 degrees relative to vertical.

15. A feeder for transporting particles comprising:

(a) a container for receiving particles, said container having a discharge area as a part thereof, said container including a bottom;

(b) a suction nozzle having an inlet end disposed adjacent said discharge area, said suction nozzle having an axis;

(c) means for creating relative motion between said inlet end and said discharge area, said motion being repetitive and bidirectional along said axis; and (d) means for directing or moving particles disposed within said container toward said discharge area, said means for directing or moving particles including at least a portion of said bottom being inclined in a direction toward said discharge area.

16. A feeder for transporting particles comprising:

(a) a container for receiving particles, said container having a discharge area as a part thereof;

(b) a suction nozzle having an inlet end disposed adjacent said discharge area, said suction nozzle having an axis;

(c) means for creating relative motion between said inlet end and said discharge area, said motion being repetitive and bidirectional along said axis;

(d) means for directing or moving particles disposed within said container toward said discharge area, said means for directing or moving particles including a vibrator disposed to vibrate at least a portion of said container.

17. A feeder for transporting particles comprising;

(a) a container for receiving particles, said container having a discharge area;

(b) a suction nozzle having an inlet end disposed adjacent said discharge area, said suction nozzle having an axis;

(c) means for creating relative motion between said inlet end and said discharge area, said motion being repetitive and bidirectional along said axis; and (d) a generally planar flange extending from said suction nozzle adjacent said inlet end.

18. The device as claimed in claim 17, wherein said suction nozzle has a generally circular cross-section, and said flange extends radially outwardly from said suction nozzle adjacent said inlet end.

19. A feeder for transporting particles comprising:

(a) a container for receiving particles, said container having a discharge area as a part thereof;

(b) suction nozzle having an inlet end disposed adjacent said discharge area, said suction nozzle having an axis, said suction nozzle including at least one air supply port for supplying air or other gas to said suction nozzle; and (c) means for creating relative motion between said inlet end and said discharge area, said motion being repetitive and bidirectional along said axis.

* * * * *

UNITED STATES PATENT AND TRADEMARK OFFICE

CERTIFICATE OF CORRECTION

PATENT NO. : 6,024,304
DATED : February 15, 2000
INVENTOR(S) : Noboru Sawada

It is certified that error appears in the above-indentified patent and that said Letters Patent is hereby corrected as shown below:

Column 8, line 6, (claim 4), change "towards" to - - toward - -

Column 8, line 30, (claim 8), change "alone" to - - along - -

Column 8, line 57, (claim 13), change "reciprocal" to - - reciprocated -

Column 10, line 15, (claim 19), before "suction" insert - - a - -

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*